US009534859B2

(12) United States Patent
Battaglia et al.

(10) Patent No.: US 9,534,859 B2
(45) Date of Patent: Jan. 3, 2017

(54) PRECISION BOLT ACTION SEMIAUTOMATIC RIFLE

(71) Applicants: Vincent P. Battaglia, Easton, CT (US); Philip Battaglia, Easton, CT (US)

(72) Inventors: Vincent P. Battaglia, Easton, CT (US); Philip Battaglia, Easton, CT (US)

(73) Assignee: Vincent P. Battaglia, Easton, CT (US)

( * ) Notice: Subject to any disclaimer, the term of this patent is extended or adjusted under 35 U.S.C. 154(b) by 0 days.

(21) Appl. No.: 14/702,016

(22) Filed: May 1, 2015

(65) Prior Publication Data

US 2016/0047611 A1 Feb. 18, 2016

Related U.S. Application Data

(60) Provisional application No. 61/988,569, filed on May 5, 2014.

(51) Int. Cl.

| | |
|---|---|
| ***F41A 3/00*** | (2006.01) |
| ***F41A 3/14*** | (2006.01) |
| ***F41A 3/66*** | (2006.01) |
| ***F41A 3/36*** | (2006.01) |
| ***F41A 3/72*** | (2006.01) |

(52) U.S. Cl.
CPC .. *F41A 3/14* (2013.01); *F41A 3/36* (2013.01); *F41A 3/66* (2013.01); *F41A 3/72* (2013.01)

(58) Field of Classification Search
CPC ..... F41A 3/14; F41A 3/66; F41A 3/36; F41A 3/72; F41A 3/18; F41A 3/26; F41A 3/82
USPC ..... 42/16
See application file for complete search history.

(56) References Cited

U.S. PATENT DOCUMENTS

| | | | | |
|---|---|---|---|---|
| 4,604,942 | A | 8/1986 | Benelli | |
| 4,930,239 | A * | 6/1990 | Hunter | F41A 3/82 42/42.01 |
| 5,581,926 | A * | 12/1996 | Taalib-din | F41A 3/82 42/16 |
| 5,959,234 | A | 9/1999 | Scaramucci et al. | |
| 5,983,549 | A | 11/1999 | Battaglia | |
| 8,230,632 | B2 | 7/2012 | Moretti | |
| 8,800,422 | B2 * | 8/2014 | Norton | F41A 3/26 42/16 |
| 9,091,505 | B1 * | 7/2015 | Battaglia | F41C 23/20 |
| 9,188,401 | B2 * | 11/2015 | Pizano | F41A 5/26 |
| 2012/0260793 | A1 * | 10/2012 | Gomez | F41A 5/18 89/191.01 |

(Continued)

*Primary Examiner* — Michelle R Clement
(74) *Attorney, Agent, or Firm* — DeLio, Peterson & Curcio, LLC; David R. Pegnataro

(57) ABSTRACT

A rifle has a receiver, a cartridge chamber connected to the receiver, and a bolt slideable longitudinally in the receiver, the bolt is engageable with a cartridge in the chamber. A bolt carrier is slideable longitudinally in the receiver to move the bolt into and out of engagement with a cartridge in the cartridge chamber, and a bolt handle is connected to the bolt carrier. The bolt handle is positionable in a manual position extending from one side of the rifle to permit manual firing of the rifle and in a semiautomatic position about 180 degrees different from the manual position and extending from the other side of the rifle to permit semiautomatic firing of the rifle. The position of the bolt carrier may be changed between the manual and semiautomatic positions without removing the bolt carrier from the rifle.

20 Claims, 26 Drawing Sheets

(56) References Cited

U.S. PATENT DOCUMENTS

| | | | | |
|---|---|---|---|---|
| 2014/0059910 | A1* | 3/2014 | Norton | F41A 3/26 42/9 |
| 2016/0146567 | A1* | 5/2016 | Nachefski | F41B 11/721 124/73 |
| 2016/0245603 | A1* | 8/2016 | Pizano | F41A 7/02 |

* cited by examiner

PRECISION BOLT ACTION SEMIAUTOMATIC RIFLE

This application claims priority to U.S. application No. 61/988,569 filed on May 5, 2014.

BACKGROUND OF THE INVENTION

1. Field of the Invention

The present invention relates to firearms and in particular to a rifle which may be alternately operated in manual bolt action mode and semiautomatic or automatic mode.

2. Description of Related Art

Optimum center fire cartridge accuracy design requires a tight breech condition in that when the bolt face is locked in battery the bolt face cannot move rearward upon ignition, thereby supporting the shoulder of the cartridge and insuring contact of the cartridge shoulder to the chamber supporting the centrality of the neck of the case at time of ignition. The slightest rearward movement (or loss of headspace) of the cartridge away from the chamber neck wall can result in off center ignition allowing the projectile to offload on its imprint into the rifling of the barrel. The resultant off-center ignition and projectile seating will cause loss of accuracy at distance. Precision bolt action rifles do not have this concern because the bolt face is locked in head space. On the other hand gas-operated semiautomatic and automatic operating systems do exhibit rearward movement of the bolt face and breech lock at time of ignition to some degree, having potential for sloppier projectile seating into the rifling of the barrel causing a lower attainable MOA or accuracy at test. This is evident in some test criteria between M16 type rifles such as the SAS110 and M40 type bolt guns. This does not degrade either weapon type; it merely is a difference between the types that has impact on achievable targets at long range. The resultant practice is that most military field both a gas gun for semi-auto volume fire and a bolt gun for precision long range fire.

Current fielded platoon and scout/sniper weapon platforms include the M4 assault weapon the M40 or M24 precision bolt action rifle and also the SAS110 semi auto sniper for volume fire. These are distinct weapons with separate missions, i.e., close quarters fire, mid range fire, and/or precision long range fire.

SUMMARY OF THE INVENTION

Bearing in mind the problems and deficiencies of the prior art, it is therefore an object of the present invention to provide a rifle in which operation may be controlled between a manual bolt action mode and a semiautomatic mode without removing components from the rifle.

It is another object of the present invention to provide a rifle which is field level convertible between close quarters fire, mid range fire, and/or precision long range fire.

Still other objects and advantages of the invention will in part be obvious and will in part be apparent from the specification.

The above and other objects, which will be apparent to those skilled in the art, are achieved in the present invention which is directed to a rifle comprising a receiver, a cartridge chamber connected to the receiver, a bolt slideable longitudinally in the receiver, the bolt being engageable with a cartridge in the cartridge chamber during firing of the cartridge, a bolt carrier slideable longitudinally in the receiver to move the bolt into and out of engagement with a cartridge in the cartridge chamber, and a bolt handle connected to the bolt carrier. The bolt handle is positionable in a manual position extending from one side of the rifle to permit manual firing of the rifle and in a semiautomatic position about 180 degrees different from the manual position and extending from the other side of the rifle to permit semiautomatic firing of the rifle. The position of the bolt carrier may be changed between the manual and semiautomatic positions without removing the bolt carrier from the rifle.

In a related aspect the present invention is directed to a method of controlling operation of a rifle between a manual bolt action mode and a semiautomatic mode comprising providing a rifle having a receiver, a cartridge chamber connected to the receiver, a bolt slideable longitudinally in the receiver, the bolt being engageable with a cartridge in the cartridge chamber during firing of the cartridge, a bolt carrier slideable longitudinally in the receiver to move the bolt into and out of engagement with a cartridge in the cartridge chamber, and a bolt handle connected to the bolt carrier. The method includes positioning the bolt handle in a manual position extending from one side of the rifle to permit manual firing of the rifle, and positioning the bolt handle in a semiautomatic position about 180 degrees different from the manual position and extending from the other side of the rifle to permit semiautomatic firing of the rifle. The position of the bolt carrier is changed between the manual and semiautomatic positions without removing the bolt carrier from the rifle.

In the manual position the bolt carrier is locked with respect to the receiver to prevent the bolt from moving rearward immediately after firing of the cartridge except by manual action of the user to move the bolt carrier and bolt rearward and wherein in the semiautomatic position the bolt carrier is unlocked with respect to the receiver to enable the bolt carrier and bolt automatically to slide longitudinally with respect to the receiver immediately after firing of the cartridge.

In another aspect the present invention is directed to a rifle comprising a receiver, a cartridge chamber connected to the receiver and a bolt slideable longitudinally in the receiver. The bolt is engageable with a cartridge in the cartridge chamber during firing of the cartridge. The rifle also includes a bolt carrier slideable longitudinally in the receiver to move the bolt into and out of engagement with a cartridge in the cartridge chamber. The bolt carrier is positionable between a manual position, in which the bolt carrier is locked with respect to the receiver to prevent the bolt from moving rearward immediately after firing of the cartridge except by manual action of the user to move the bolt carrier and bolt rearward, and a semiautomatic position, in which the bolt carrier is unlocked with respect to the receiver to enable the bolt carrier and bolt to automatically slide longitudinally with respect to the receiver immediately after firing of the cartridge.

The bolt carrier may have a slot extending around at least a portion of a periphery thereof, and further may include a bolt coupler having a projection slideable within the bolt carrier peripheral slot, wherein the bolt coupler is rotatable in one direction around the bolt carrier to lock the bolt carrier to prevent longitudinal movement with respect to the receiver, and rotatable in an opposite direction around the bolt carrier to unlock the bolt carrier and permit longitudinal movement with respect to the receiver.

The receiver may have a slot extending around at least a portion of a periphery thereof, and further may include a handle on the bolt coupler, wherein the bolt coupler handle is slideable in the receiver slot as the bolt coupler is rotated to lock and unlock the bolt carrier with respect to the receiver.

The rifle may further include an operating spring between the bolt and the bolt carrier. The operating spring is disengaged when the bolt carrier is in the manual position, wherein the operating spring is uncompressed and the bolt and bolt carrier cannot move with respect to each other immediately after firing of the cartridge, and the operating spring is engaged when the bolt carrier is in the semiautomatic position, wherein the bolt and bolt carrier may move longitudinally with respect to each other to compress the operating spring immediately after firing of the cartridge.

The rifle may further include a bolt carrier with a cam slot extending longitudinally and having an angled portion, wherein the bolt has a pin slideable in the bolt carrier cam slot, and wherein position of the bolt pin in the cam slot controls compression and expansion of the operational spring between the bolt and the bolt carrier. In the bolt carrier manual position, the bolt pin is at the forward portion of the bolt carrier cam slot, and in the bolt carrier semiautomatic position, the bolt pin is in an intermediate portion of the bolt carrier cam slot. The position of the bolt pin in the cam slot changes between the manual position, in which the bolt carrier is locked with respect to the receiver, and the semiautomatic position, in which the bolt carrier is unlocked with respect to the receiver.

In a related aspect, the invention is directed to a method of controlling operation of a rifle between a manual bolt action mode and a semiautomatic mode. In a first step, the method comprises providing a rifle having a receiver, a cartridge chamber connected to the receiver, a bolt slideable longitudinally in the receiver, wherein the bolt may be engageable with a cartridge in the cartridge chamber during firing of the cartridge, and a bolt carrier slideable longitudinally in the receiver to move the bolt into and out of engagement with a cartridge in the cartridge chamber. In a second step, the method comprises positioning the bolt carrier in a first manual position in which the bolt carrier is locked with respect to the receiver to prevent the bolt from moving rearward immediately after firing of the cartridge except by manual action of the user to move the bolt carrier and bolt rearward. In a third step, the method comprises positioning the bolt carrier in a second semiautomatic position different from the first position, in which the bolt carrier is unlocked with respect to the receiver to enable the bolt carrier and bolt automatically to slide longitudinally with respect to the receiver immediately after firing of the cartridge.

The position of the bolt carrier may be changed without removing the bolt carrier from the rifle. The position of the bolt carrier may be determined by a bolt coupler having a handle, wherein moving the bolt coupler handle changes the bolt carrier from the first manual position to the second semiautomatic position. The bolt carrier may have a cam slot and the bolt may have a pin slideable in the bolt carrier cam slot, wherein moving the position of the bolt pin in the bolt carrier cam slot changes the bolt carrier from the first manual position to the second semiautomatic position.

The bolt carrier may have a slot extending around at least a portion of a periphery thereof, and further including a bolt coupler may have a projection slideable within the bolt carrier peripheral slot. The method includes rotating the bolt coupler in one direction around the bolt carrier to lock the bolt carrier to prevent longitudinal movement with respect to the receiver and rotating the bolt coupler in an opposite direction around the bolt carrier to unlock the bolt carrier and permit longitudinal movement with respect to the receiver.

The receiver may have a slot extending around at least a portion of a periphery thereof, and there may be a handle on the bolt coupler. The method includes sliding the bolt coupler in the receiver slot as the bolt coupler is rotated to lock and unlock the bolt carrier with respect to the receiver.

There may be further included an operating spring between the bolt and the bolt carrier, and the method includes disengaging the operating spring when the bolt carrier is in the manual position wherein the operating spring is uncompressed and the bolt and bolt carrier cannot move with respect to each other immediately after firing of the cartridge, and engaging the operating spring when the bolt carrier is in the semiautomatic position wherein the bolt and bolt carrier may move longitudinally with respect to each other to compress the operating spring immediately after firing of the cartridge.

The bolt carrier may include a cam slot extending longitudinally and has an angled portion and the bolt may have a pin slideable in the bolt carrier cam slot. The method includes controlling compression and expansion of the operational spring between the bolt and the bolt carrier by position of the bolt pin in the cam slot.

The method includes in the bolt carrier manual position having the bolt pin at the forward portion of the bolt carrier cam slot and in the bolt carrier semiautomatic position having the bolt pin in an intermediate portion of the bolt carrier cam slot.

In another aspect, the invention is directed to a rifle comprising a chassis, a receiver secured to the chassis, wherein the receiver has an opening at a rear end thereof and a moveable pawl aligned with the opening, and a butt stock having a buffer tube therein, wherein the butt stock is securable to the chassis by at least one lug extending outward from a front end of the buffer tube. The front end of the buffer tube may be disposed in the rear end of the receiver and the pawl engaging at least one lug through the receiver opening. The butt stock may be removable from the chassis by disengaging the pawl from at least one lug and rotating the buffer tube with respect to the receiver and subsequently pulling the butt stock away from the chassis and receiver.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S) OF THE INVENTION

In describing the preferred embodiment of the present invention, reference will be made herein to FIGS. 1-30 of the drawings in which like numerals refer to like features of the invention.

The present invention provides a rifle that is selectable in its modes of operation between a manual hand operation to chamber, fire and eject the cartridge on the one hand and semiautomatic or fully automatic operating cycles to chamber, fire and eject the cartridge on the other hand. The rifle may be multi-caliber with a quick change barrel and bolt face; and further includes an adaptive cartridge magazine system capable of housing a plurality of cartridge geometries, loads, projectiles and in an adaptive capacity within the confines of a standardized semi-rectangular magazine well opening in the rifle. The selectable rifle operating system comprises a breech lockable bolt face housed in a carrier that is augmented with a power or operational spring, return spring, deceleration buffer, sequencing cam for the function of semi and full automatic operation. A coupler positioned in the assembly can be rotated 180 degrees by means of the bolt coupler handle to engage or disengage between manual hand operation and semi-automatic. The mode of full automatic or machine gun is a function of the trigger selector urging a slipping sear or ratchet into operation.

The relative positional terms used herein are described as being forward if closer to the barrel and muzzle end of the rifle, and rearward if closer to the opposite, butt stock end of the rifle. The term longitudinal is used with respect to the longitudinal axis of the barrel or rifle, and the term transverse, perpendicular or normal is with respect to the longitudinal axis. The terms upper and lower, right and left, and clockwise and counterclockwise are referenced with respect to the user's normal position holding the rifle and looking down the barrel toward the muzzle end of the rifle. Reference to the semiautomatic position and operation includes fully automatic operation, if the semiautomatic operation is disabled to permit continued chambering, firing and ejection of the cartridges while the trigger remains depressed.

Figure 1:
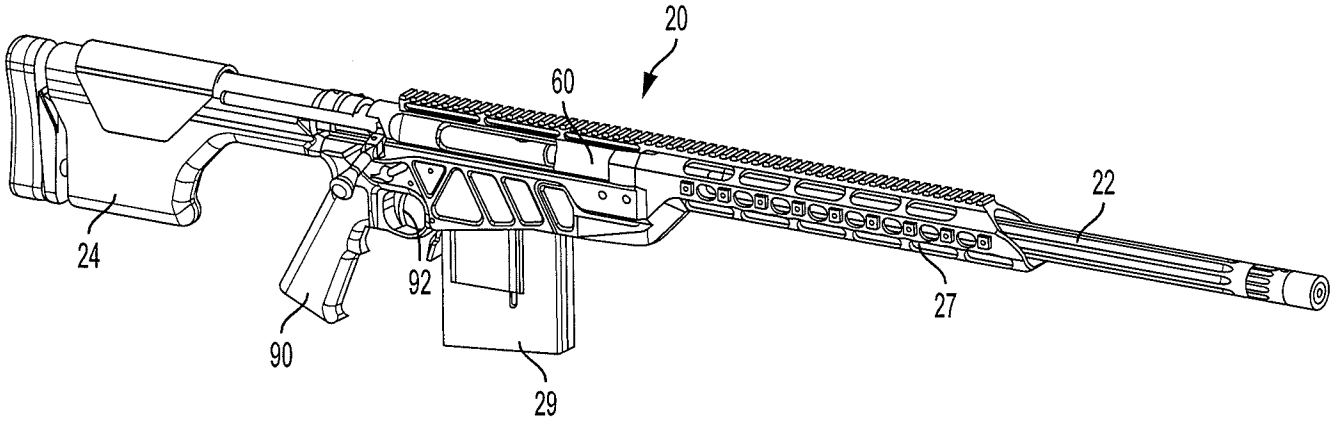
FIG. 1 is a perspective view of an embodiment of the rifle of the present invention.
Figure 2:
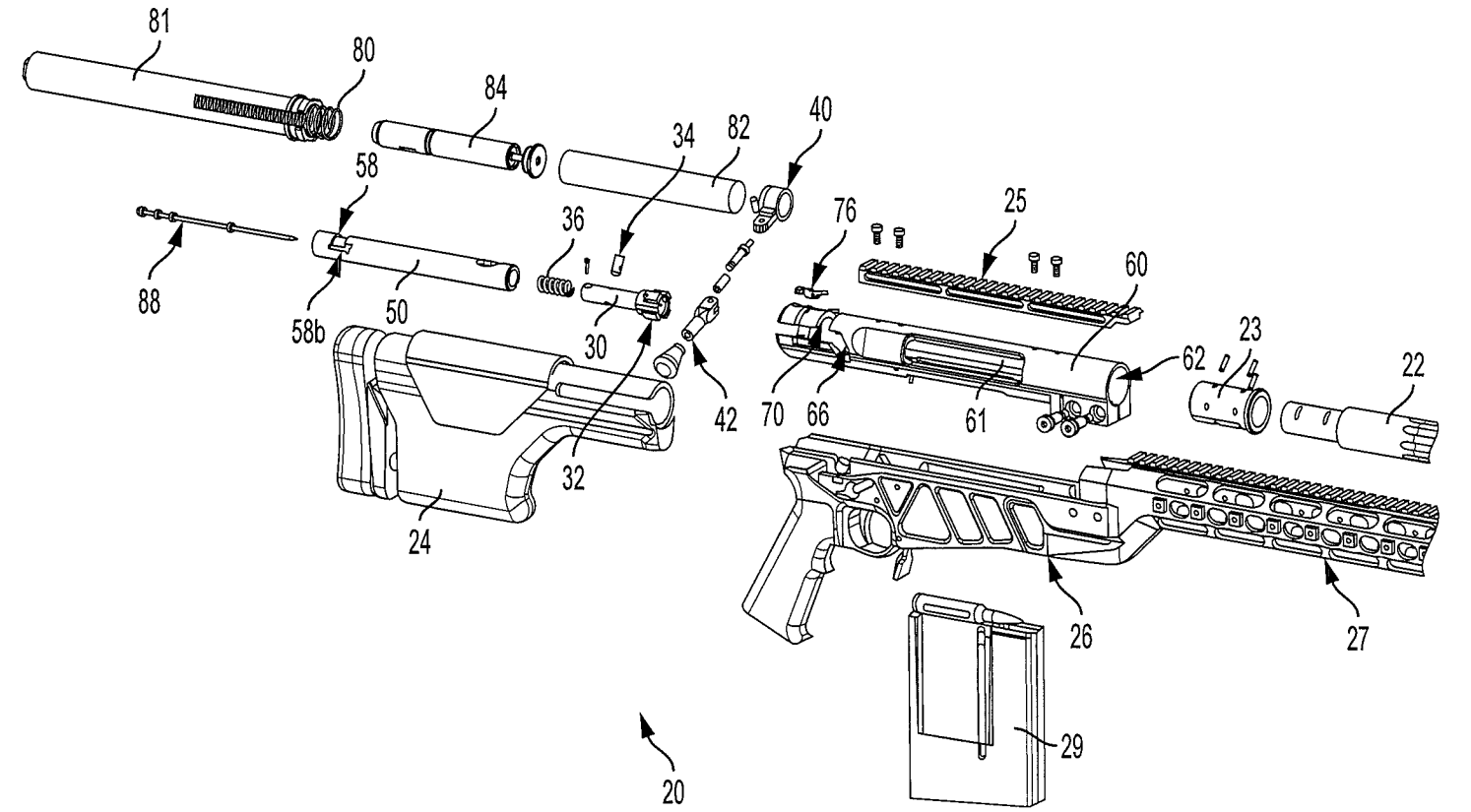
FIG. 2 is a perspective exploded view of the rifle of FIG. 1.

FIG. 1 shows an embodiment of the assembled rifle of the present invention and FIG. 2 shows the rifle of FIG. 1 in exploded view. As also shown in the other figures, rifle 20 has a butt stock 24, chassis 26 and forestock 27 along its longitudinal axis, with a pistol grip 90 and trigger 92 extending from below the chassis and a receiver 60 above the chassis. A barrel 22 is mounted on the forestock and a barrel extension 23 connects barrel 22 to breech 68 end at front end 60*a* of receiver 60, containing the chamber 62 for firing cartridge 21 supplied from magazine 29. A rail 25 for a scope may be mounted above receiver 60. Slideable within receiver 60 is bolt 30 and bolt carrier, between which is operating spring 36 Firing pin 88 extends through bolt carrier 50 and bolt 30 and is propelled forward by a trigger-actuated hammer 28 extending through an opening in the bottom of receiver 60. Bolt coupler 40 has handle and slides over the rearward end of bolt carrier 50 to control the positioning of bolt carrier 50, and the selection of manual or semiautomatic/automatic firing modes. Within butt stock 24 is buffer tube 81 carrying return spring 80, which is itself covered by return spring shroud 82. Buffer 84 sits within return spring 80 and adjustable weight 86 abuts the rear of bolt coupler 40.

Bolt carrier 50 may be of hollow cylindrical construction, with a transverse slot 58 extending around an upper portion of the periphery at near its rear. On the right side of transverse slot 58 is a forward extending portion or pocket 58*b*. On the left side of bolt carrier 50 is a longitudinal slot 51 which extends along the lower side and connects at its rear to transverse slot 58. Transverse slot 58 itself has a pocket 59 at the rear portion of the slot edge on the left side of bolt carrier 50. Along the front top of bolt carrier 50 is a cam slot 52 which has a front portion 52*a* that extends straight and at an acute angle to the longitudinal axis, and a connecting rear portion 52*b* that extends straight in the direction of the longitudinal axis. Bolt 30 has a perpendicular cam pin 34 extending into cam slot 52 at the forward end of the bolt carrier 50.

Figure 3:
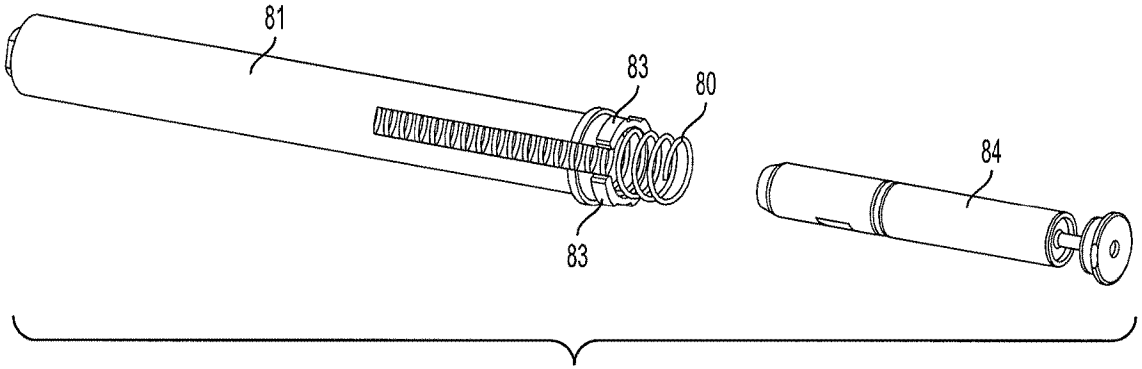
FIG. 3 is a perspective exploded view of the buffer tube, return spring and buffer in the rifle of FIG. 1.
Figure 4:
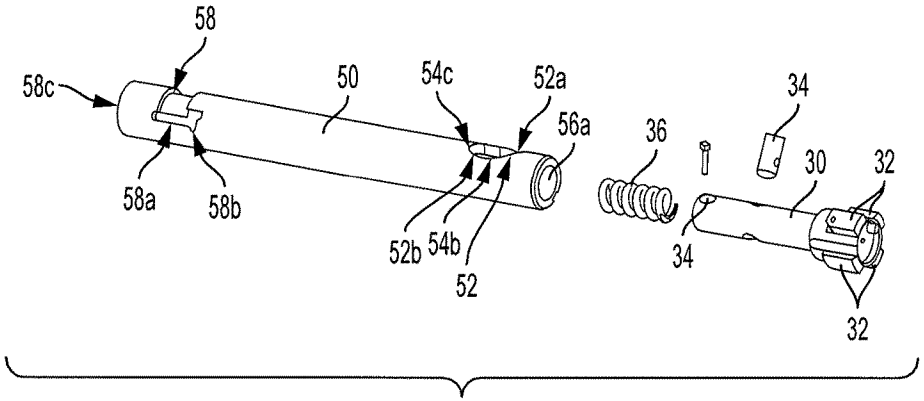
FIG. 4 is a perspective exploded view of the right side of the bolt carrier, operating spring and bolt in the rifle of FIG. 1.
Figure 5:
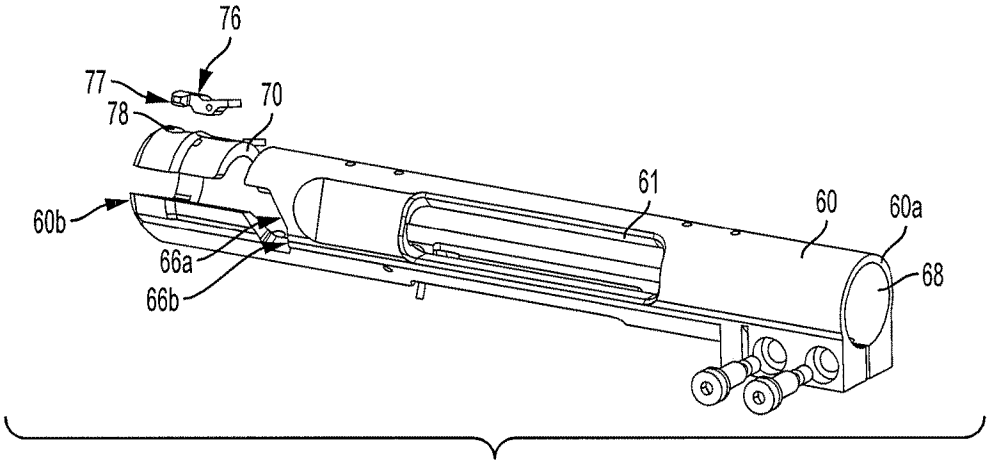
FIG. 5 is a perspective view of the right side of the receiver in the rifle of FIG. 1.
Figure 6:
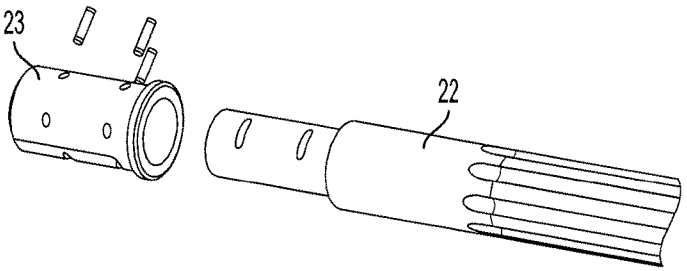
FIG. 6 is a perspective exploded view of the barrel collar and rear end of the barrel in the rifle of FIG. 1.
Figure 7:
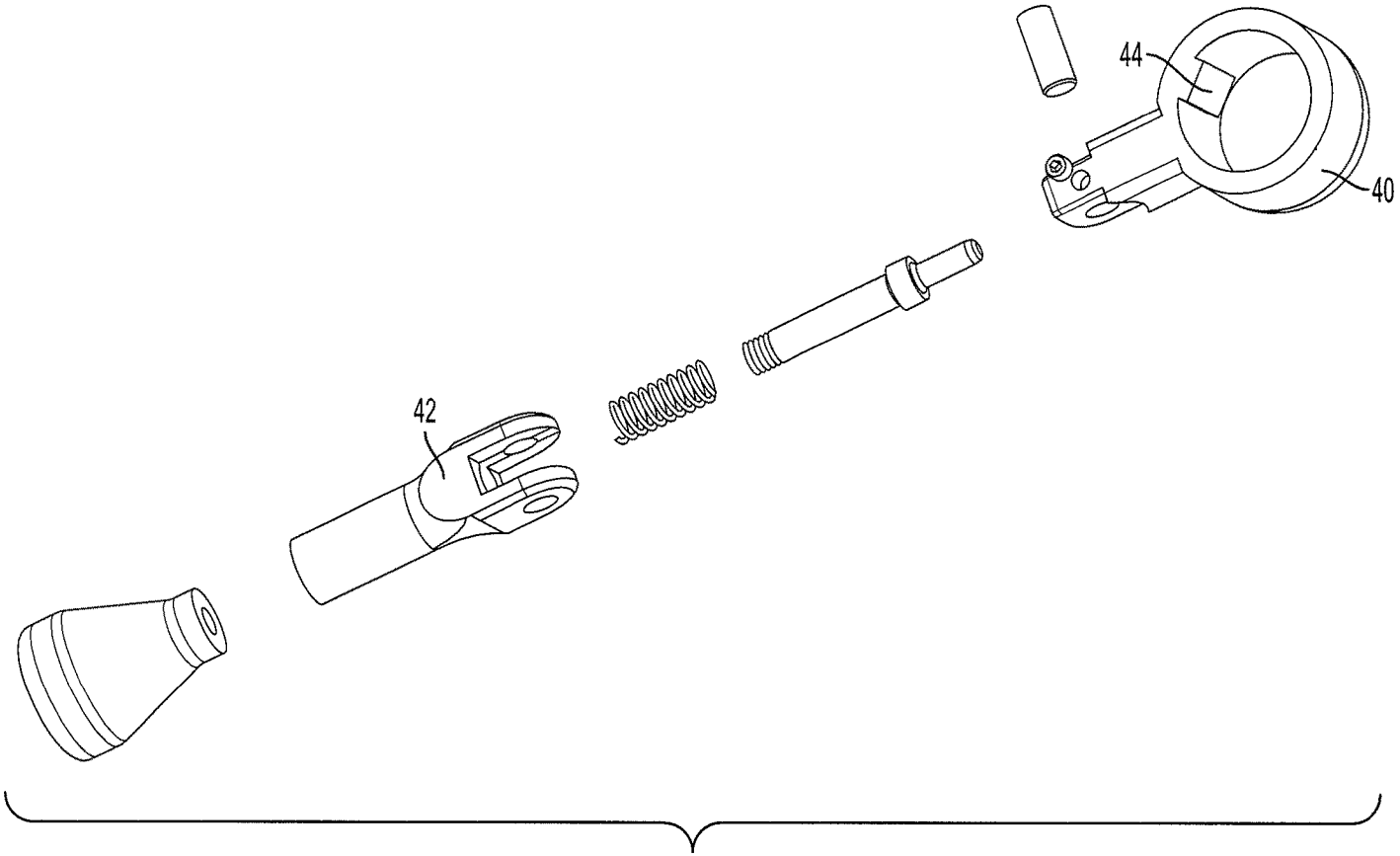
FIG. 7 is a perspective exploded view of the bolt coupler and handle in the rifle of FIG. 1.
Figure 8:
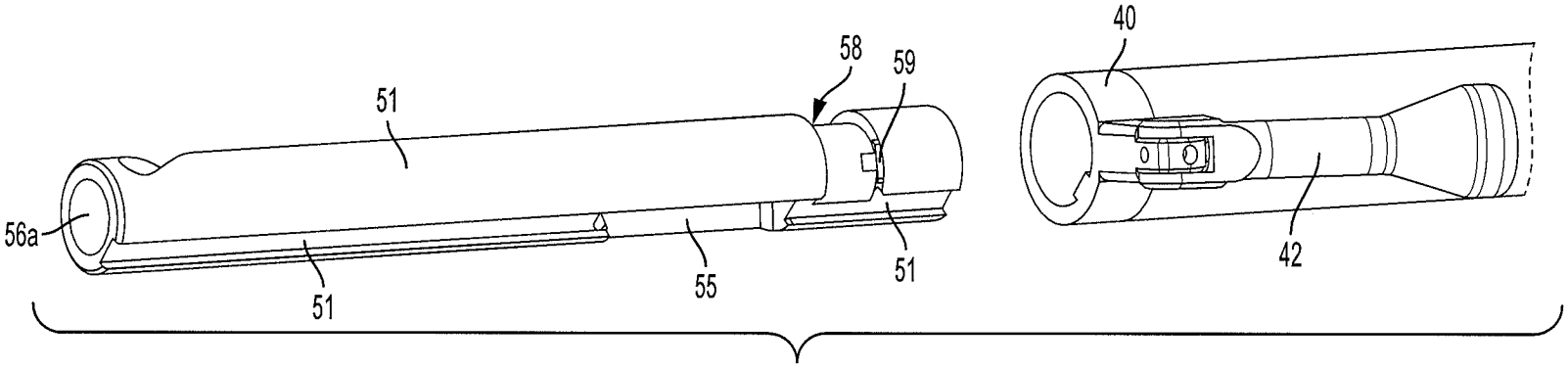
FIG. 8 is a perspective exploded view of the left side of the bolt carrier and bolt coupler in the rifle of FIG. 1.
Figure 27A:
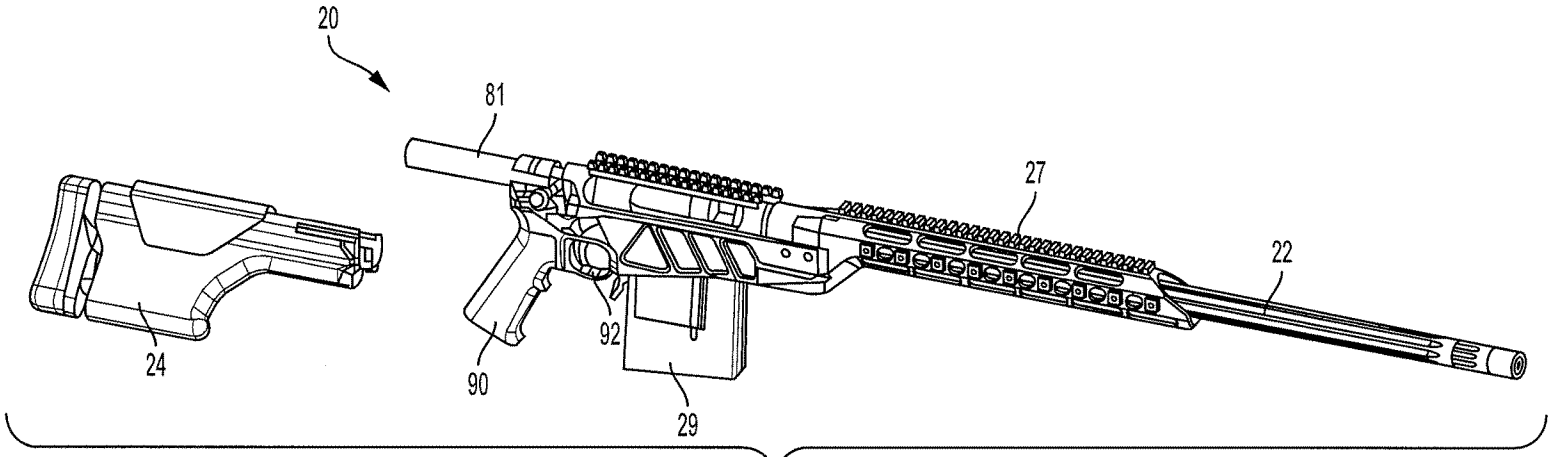
FIGS. 27*a* and 27*b* are perspective view of the disassembly and caliber change of the rifle of FIG. 1.
Figure 27B:
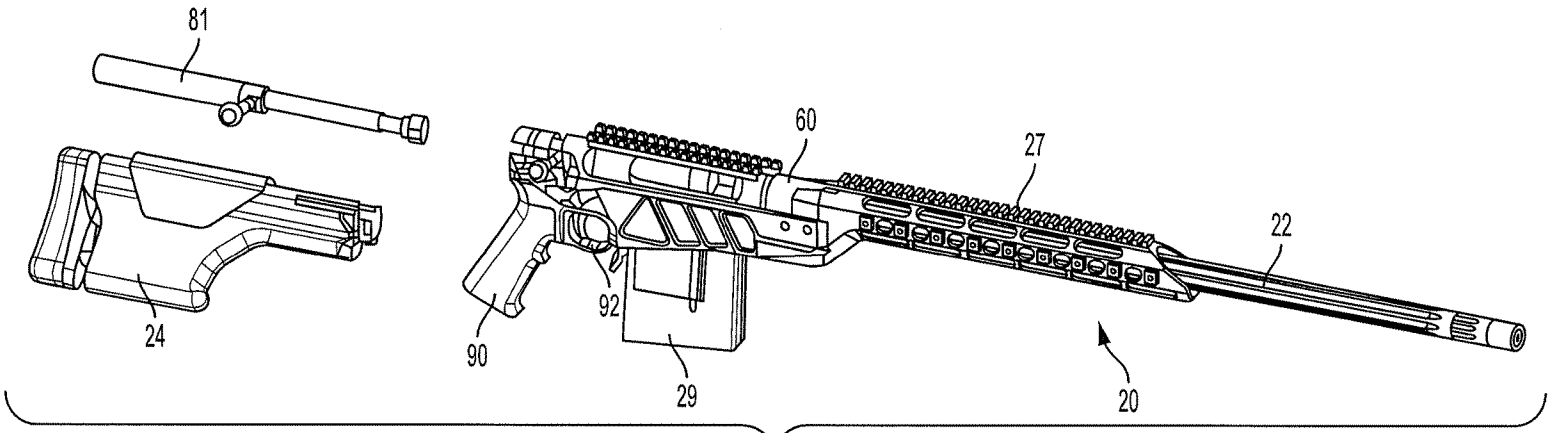

Cylindrical buffer tube 81 is secured within butt stock 24, and has one or more spaced lugs 83 extending radially outward at the forward end, as shown in FIG. 3. To enable *facile* securing and removal of butt stock 24 from chassis 26, the cylindrical rear end 60*b* of receiver 60 includes an opening 78 in the receiver wall and a pivotable lock lever 76 with a pawl 77 at an end thereof that fits through the opening, as shown in FIG. 5. When butt stock 26 is secured to chassis 26, buffer tube lugs 83 are held by pawl 77 through opening 78. When the butt stock is to be removed, the user presses the end of lever lock 76 opposite pawl 77 to move the pawl upward and free the constraint on lugs 83. The butt stock and buffer tube may then be rotated around the longitudinal axis as shown in FIG. 3 no more than about 90 degrees, e.g., about 45 degrees, to remove the butt stock and buffer tube from the chassis and receiver. Disassembly and replacement of the butt stock and caliber change are also shown in FIGS. 27*a* and 27*b*, which includes opening the receiver latch, rotating the butt stock assembly 45 degrees and remove, and sliding out the inertial bolt assembly. At this point a cleaning patch may be passed through the barrel. The caliber may be changed by loosening the two bolts in the center section, rotating the barrel, and pulling it out. The bolt face and magazine may be changed to the new desired caliber.

Figure 9:
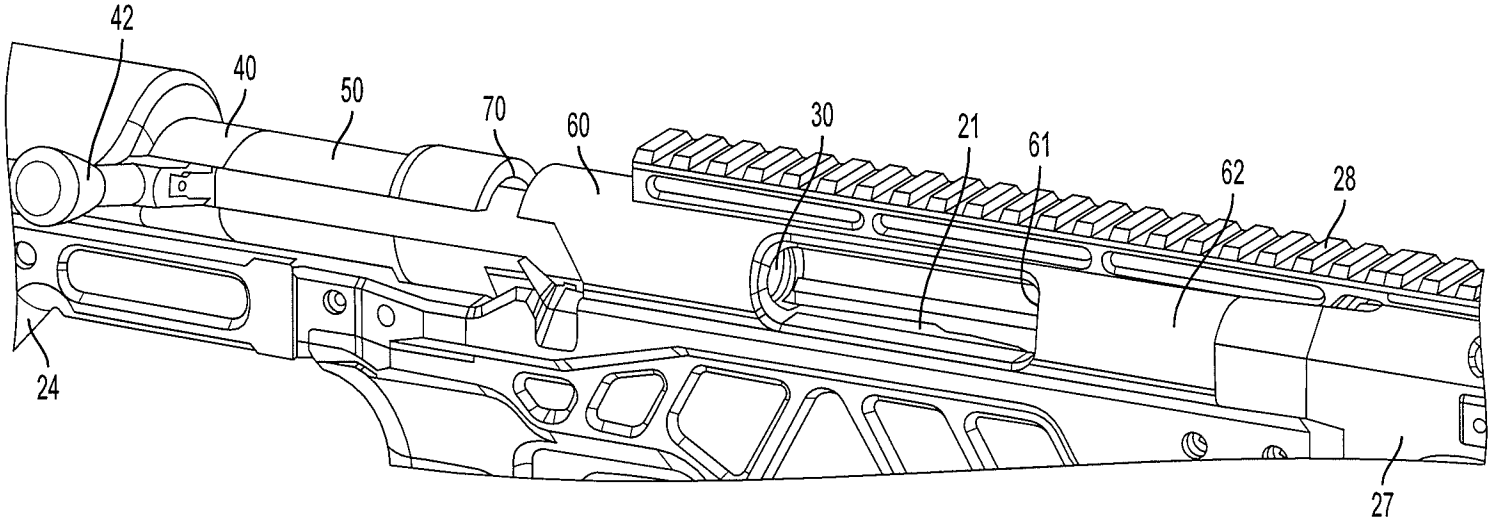
FIG. 9 is a perspective view of the rifle of FIG. 1 in the manual mode wherein the bolt is in the fully rearward position, the handle of the bolt coupler is rotated clockwise and the hammer is in the cocked position.
Figure 10:
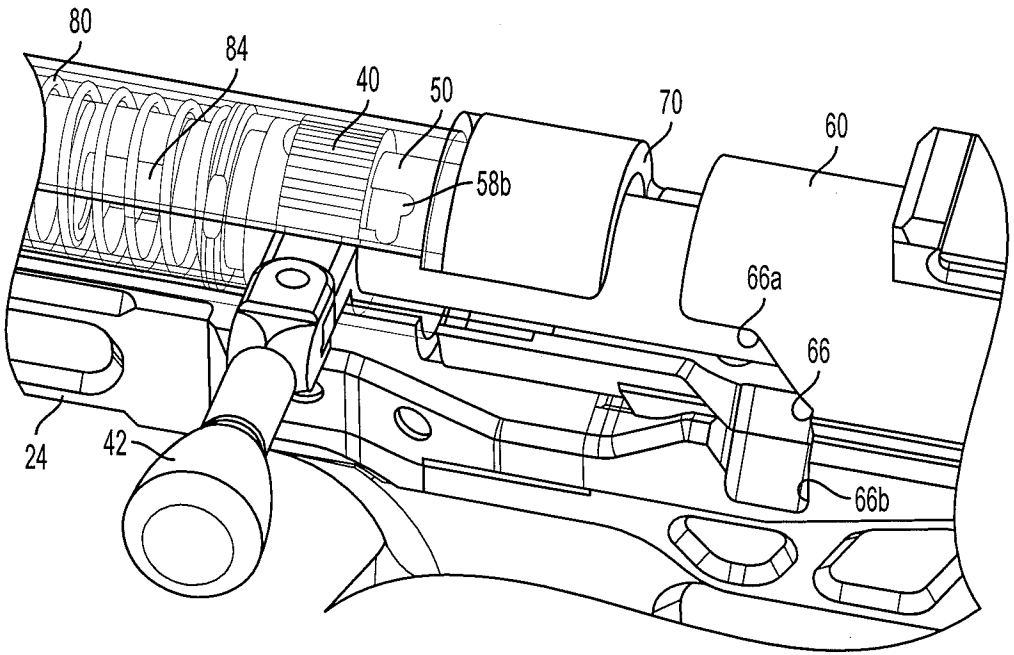
FIG. 10 is a semi-transparent perspective view of the rifle of FIG. 1 in the manual mode wherein the bolt coupler handle is pushed forward, moving the bolt carrier and bolt forward, stripping a cartridge from the magazine into the receiver chamber.

The manual bolt action mode firing sequence is shown in FIGS. 9-16 and can be described as follows. In FIG. 9 bolt 30 is in the fully rearward position and the handle of bolt coupler 40 is rotated clockwise so that it is on the right side of the rifle. Hammer 28 is in the cocked position, and bolt lugs 32 are rearward of the uppermost cartridge 21 in magazine 29 awaiting chambering. Bolt lugs 32 slide in longitudinally extending tracks 64 on the inner wall of receiver 60 to prevent rotation of the bolt 30 during travel rearward away from and forward toward chamber 62 in the forward portion of receiver 60. All throughout the manual bolt action mode the bolt cam pin 34 is seated at the forward end 54*a* of the bolt carrier cam slot 52 and the operating spring 36 is uncompressed and floating loosely between the bolt 30 rear end and the shoulder 56*b* inside bolt carrier 50 between the larger diameter front bore 56*a* and the smaller diameter rear bore 56*c*. In FIG. 10 the user pushes the bolt coupler handle 42 forward, which also moves bolt carrier 50 and bolt 30 forward toward the barrel collar 23 and chamber 62. During this motion cartridge 21 is stripped from magazine 29 by bolt lug 32 and carried forward and chambered in receiver chamber 62. Return spring 80 expands and follows bolt coupler 40 and keeps bolt carrier rear peripheral slot 58 engaged with the rear of inward projecting bolt coupler lug 44. During this forward motion the bolt 30 cannot rotate because of the lugs 32 sliding in tracks 27. Bolt cam pin 34 in bolt carrier angled cam slot portion 52*a* exerts a counterclockwise force on bolt carrier 50 as it attempts to slide rearward in angled cam portion 52*a*, but bolt carrier 50 is prevented from rotating in that direction by bolt coupler lug 44 bearing on the right end 58*a* of bolt carrier rear peripheral slot 58. The result is that bolt cam pin 34 is held at the forward end 54*a* of bolt carrier cam slot 52, and bolt 30 is rigidly connected longitudinally to bolt carrier 50 and propelled forward as bolt coupler lug 44 engages bolt carrier rear peripheral slot 58.

Figure 12:
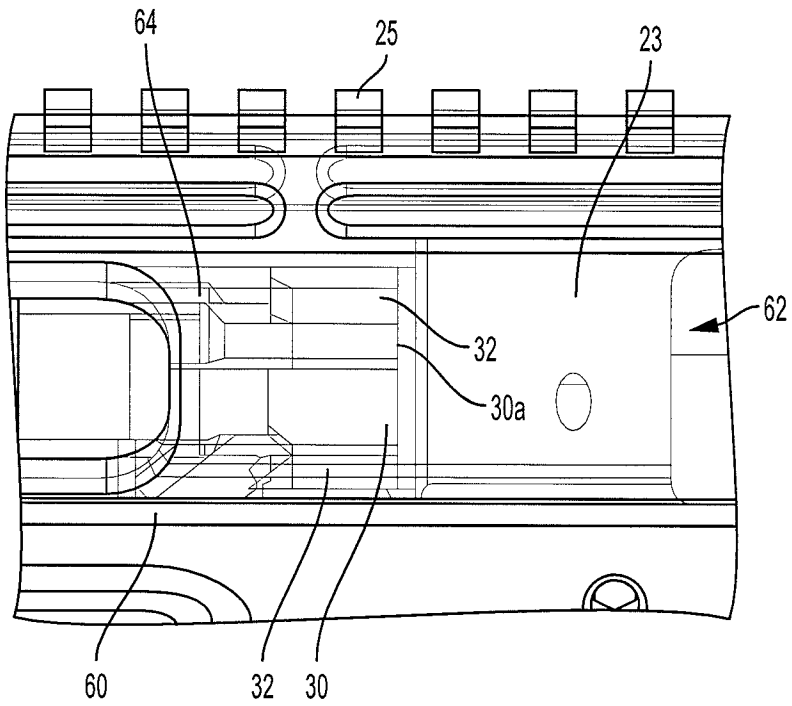
FIG. 12 is a semi-transparent side elevational view of the rifle of FIG. 1 in the manual mode wherein, at the time of the motion of FIG. 11, the bolt lugs rotate and begin to lock into battery position in the chamber.
Figure 11:
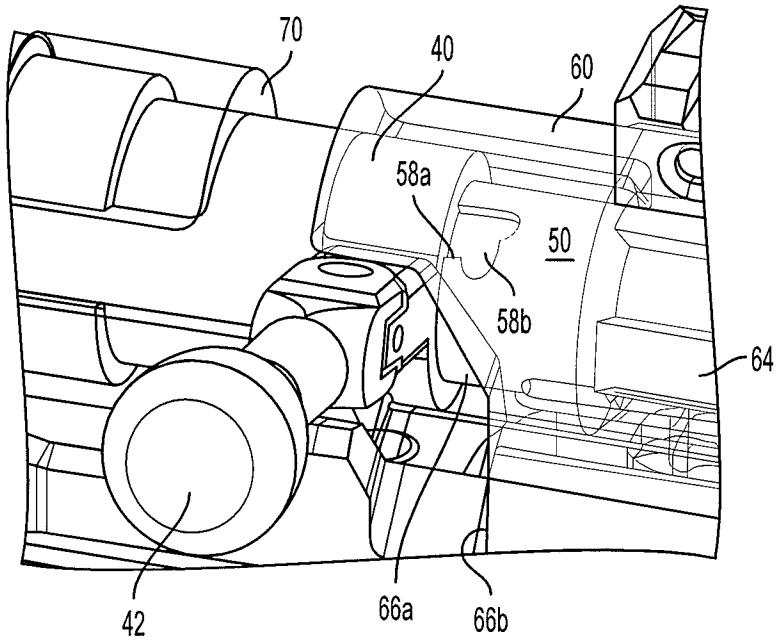
FIG. 11 is a semi-transparent perspective view of the rifle of FIG. 1 in the manual mode wherein the bolt coupler slides inside of the receiver and the handle begins to engage the right side cam slot of the receiver.
Figure 13:
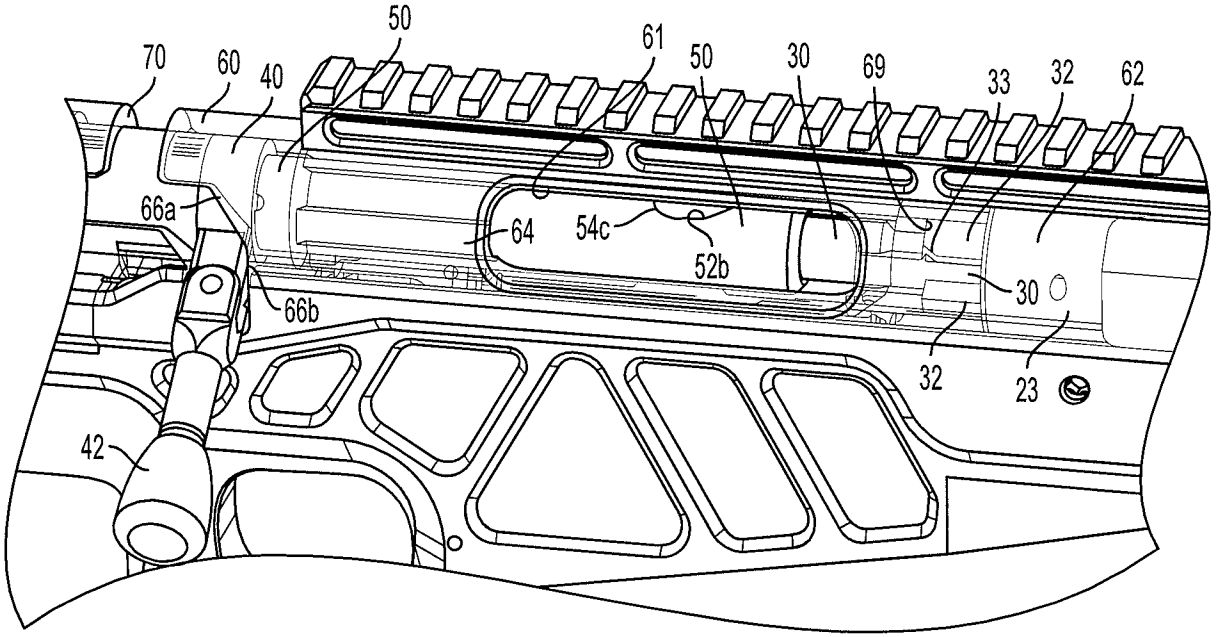
FIG. 13 is a semi-transparent perspective view of the rifle of FIG. 1 in the manual mode wherein the final clockwise rotation of the bolt coupler handle fully locks the bolt into battery position.
Figure 14:
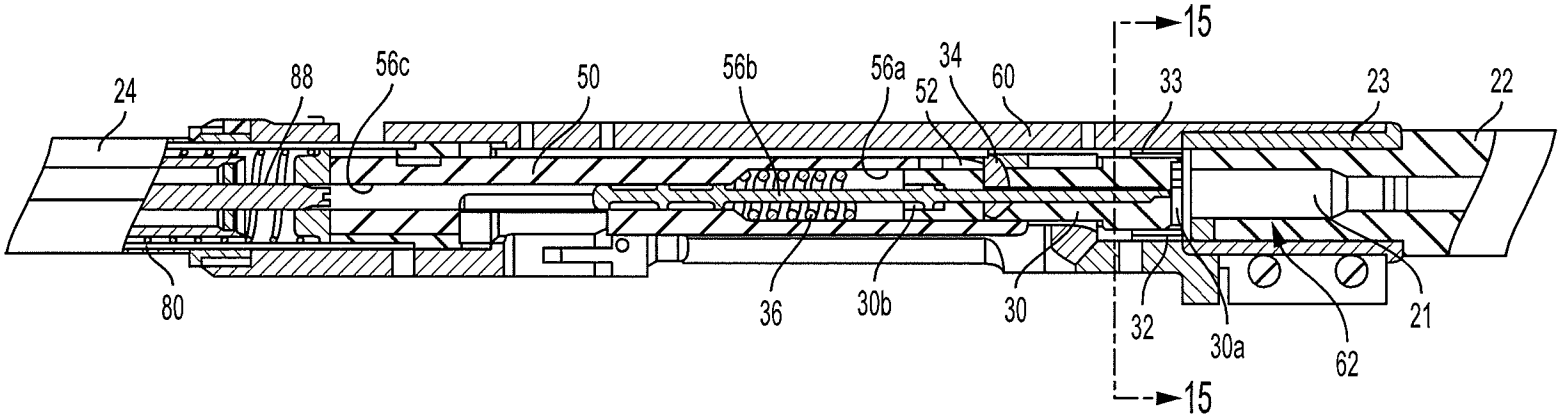
FIG. 14 is a side elevational cross section of the rifle of FIG. 1 in the manual firing position of FIG. 13 wherein the bolt cam pin is seated at the forward end of the bolt carrier cam slot and the operating spring is uncompressed and floating loosely between the bolt rear end and the shoulder inside the bolt carrier.
Figure 15:
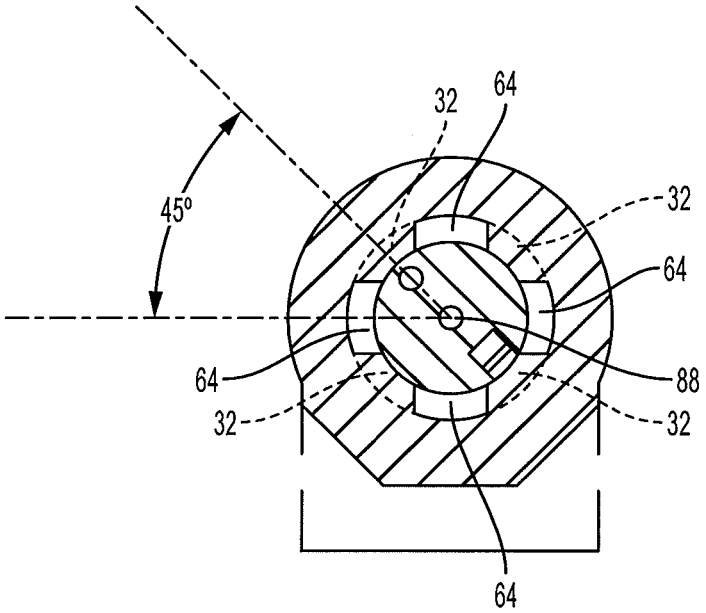
FIG. 15 is a cross section of the rifle of FIG. 1 in the firing position of FIG. 13, along line 15-15 of FIG. 14 and normal to the longitudinal axis, wherein the bolt lugs have rotated about 45 degrees around the longitudinal axis from the unlocked to the locked position.
Figure 16:
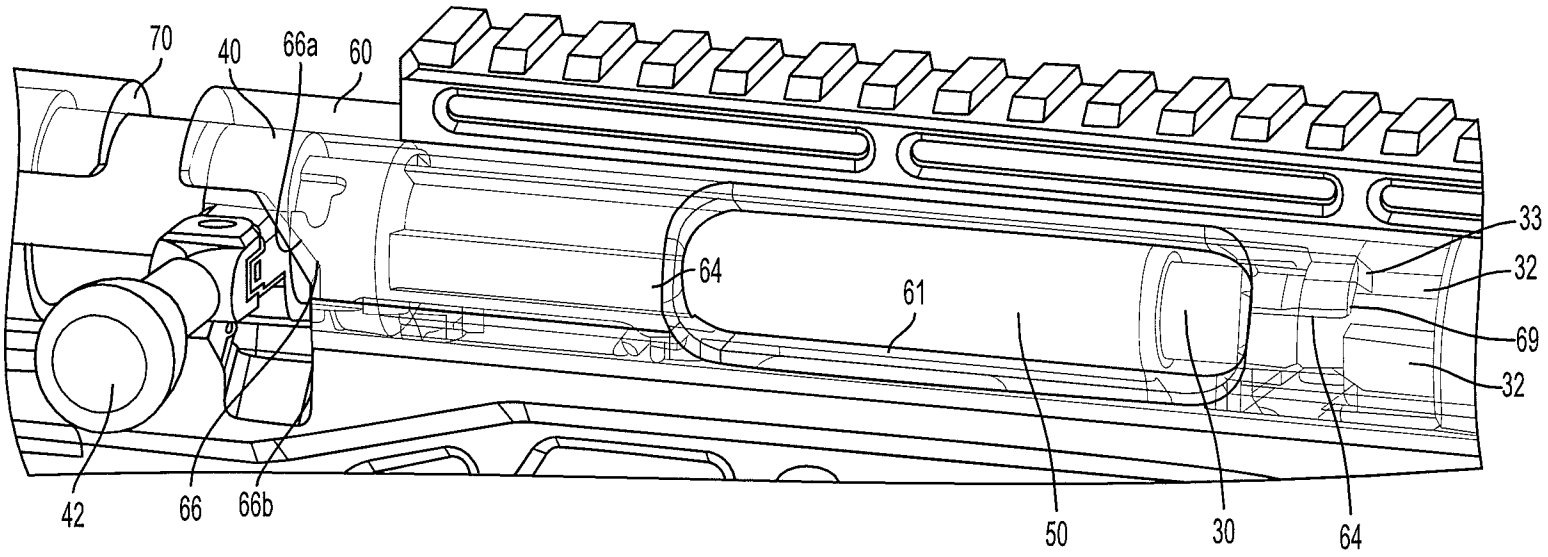
FIG. 16 is a semi-transparent perspective view of the rifle of FIG. 1 in the manual mode wherein, after firing, the bolt coupler handle is moved up and back through the receiver cam slot, which causes the bolt carrier and bolt to rotate counterclockwise since the bolt coupler lug is engaged in a pocket of the right end of the bolt carrier slot.

As bolt coupler 40 nears the end of its forward travel, in FIGS. 11 and 12 the bolt coupler slides inside receiver 60 forward of receiver transverse slot or track 70 and bolt coupler handle 42 begins to engage the right side cam slot 66 in receiver 60 and the user continues to push forward while moving the handle clockwise down and forward through the receiver cam slot upper portion 66*a* and then clockwise straight down through receiver cam slot lower portion 66*b*. This handle rotation causes clockwise rotation of bolt carrier 50 as bolt coupler internal lug 44 bears against the right end 58*a* of bolt carrier rear peripheral slot 58. During the forward motion and rotation through receiver cam slot upper portion 66*a*, which is about ⅓ of the total rotation, flank angles 33 at the rear of each of bolt lugs 32 move beyond breech shoulder 69 and lugs 32 rotate and begin to lock into battery position contacting the base of cartridge 21 in chamber 62. In FIG. 13 the user makes the final clockwise rotation of bolt coupler handle 42. During the rotation of handle through receiver cam slot lower portion 66*b*, which is about ⅔ of the total rotation, lugs 32 continue to rotate and fully lock into battery position. As shown in FIG. 14, when in manual bolt action mode firing position bolt cam pin 34 is seated at the forward end 54*a* of the bolt carrier cam slot 52 and the operating spring 36 is uncompressed and floating loosely between the bolt 30 rear end and the shoulder 56*b* inside bolt carrier 50 between the larger diameter front bore 56*a* and the smaller diameter rear bore 56*c*. In total lugs 32 rotate about 45 degrees around the longitudinal axis between unlocked and locked positions as shown in FIG. 15, which is a cross section along lines 15-15 of FIG. 14. Because of the force of return spring, bolt coupler lug 44 is pushed forward into front portion or pocket 58*b* of the right end of bolt carrier slot 58, which also urges the bolt carrier 50 forward.

Figure 29:
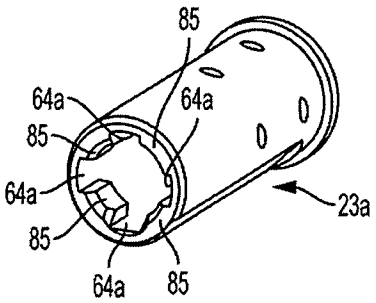
FIG. 29 is a perspective view from the area of the barrel extension of FIG. 28.
Figure 28:
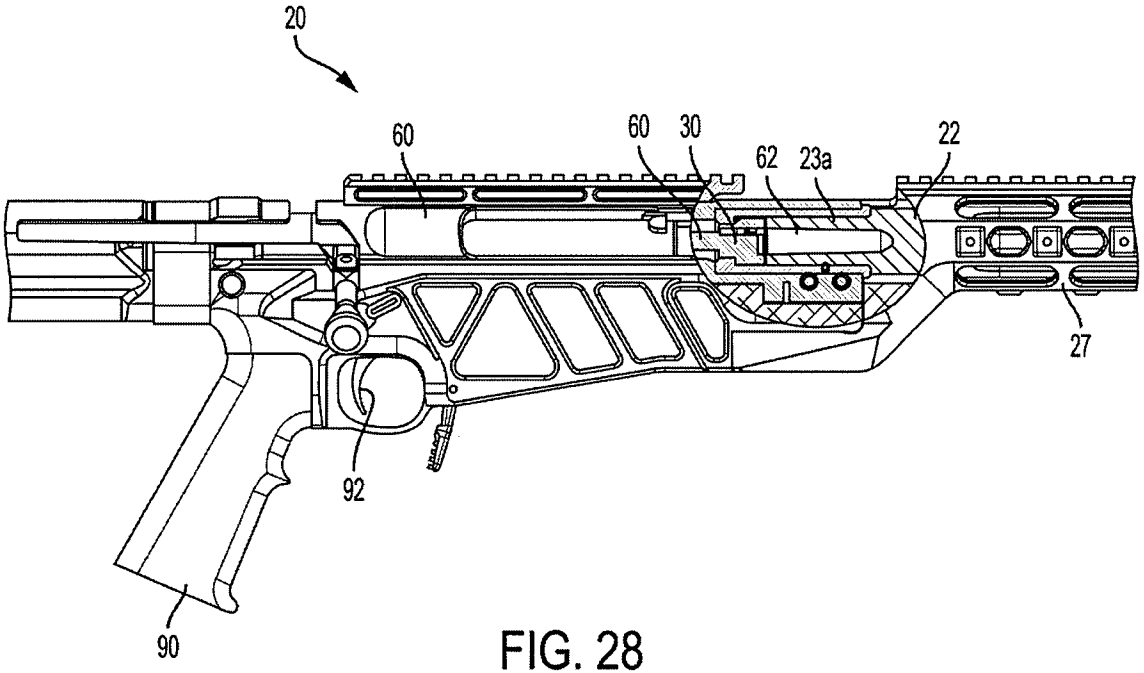
FIG. 28 is a side view of a middle portion of the rifle of FIG. 1 having a portion shown in vertical cross-section, offset from the central longitudinal axis of the barrel, at the front of the receiver and the rear of the barrel employing an alternate embodiment of the barrel extension.
Figure 30:
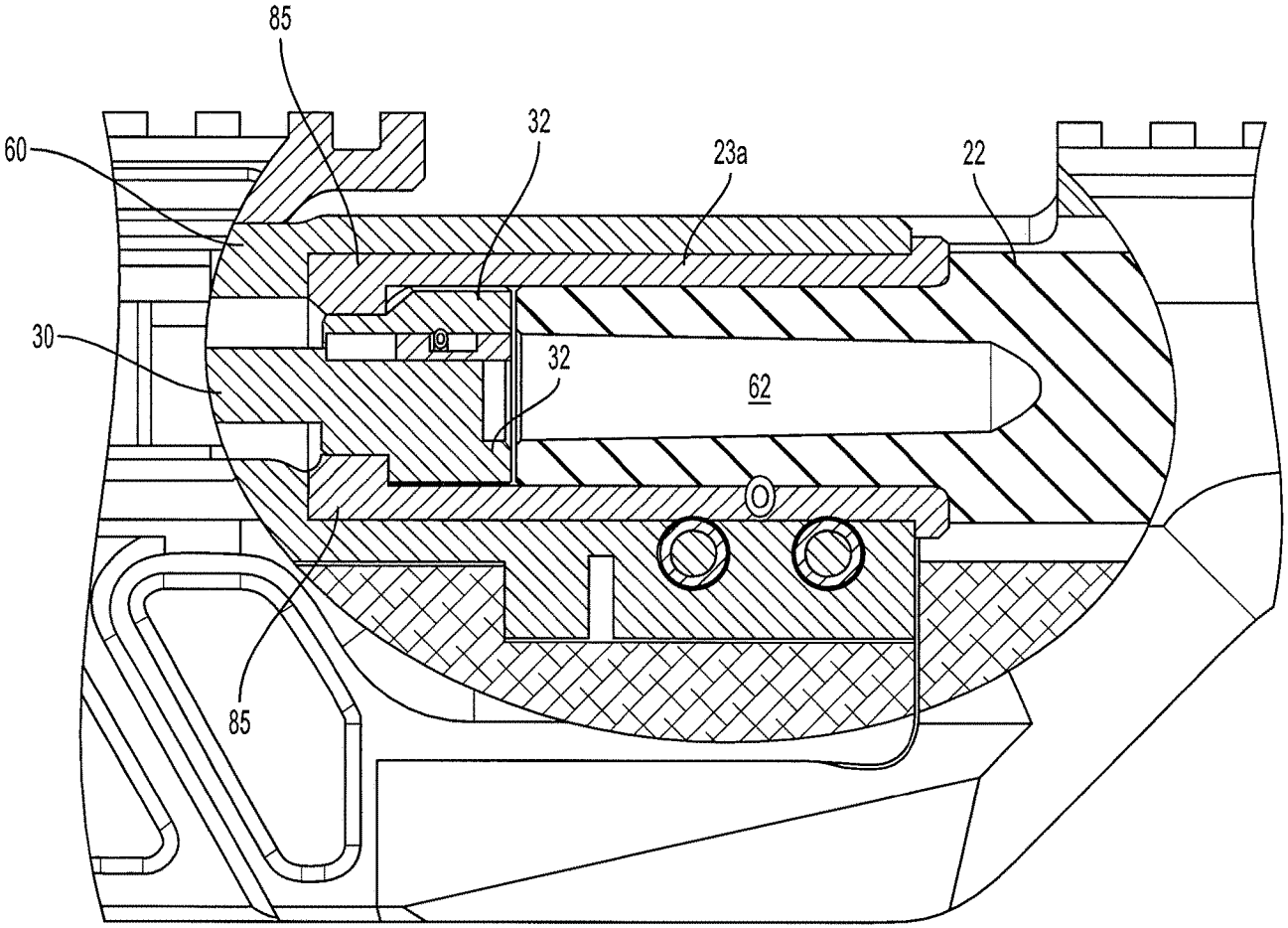
FIG. 30 is a close-up view of the vertical cross-section of the rifle of FIG. 28, offset from the central longitudinal axis of the barrel.

The portion of chamber 62 forward of the locked bolt 30 is referred to as the head space. As shown in FIG. 14, bolt lugs 32 are rotated with respect to receiver internal tracks 64 and bear against breech shoulder 69 in the receiver 60. As an alternate embodiment, barrel extension 23*a* may be employed, as shown in FIGS. 28-30. Barrel extension 23*a* is longer than barrel extension 23 as shown and described above, and includes at its rear end internal tracks 64*a* which line up and match with tracks 64 formed between inwardly extending shoulder segments 85 at the forward end of the receiver. At its forward position, bolt lugs 32 pass through tracks 64*a* and, upon rotation, bear and lock against shoulder segments 85 to place bolt 30 in contact with the cartridge in chamber 62. By employing shoulders 85 formed in the barrel extension to hold the bolt in battery position, rather than shoulder 69 formed by the receiver breech at the forward ends of track 64, the dimensions of the chamber head space are made independent of the receiver and may be more readily controlled to tight specifications.

Problems may occur during this operation. If the lugs remain fixed then the bolt coupler handle 42 could be forced to rotate up. This is prevented by a small detent that cannot be overcome by the spring pressure but can easily be overcome by force applied by the user. If the bolt coupler handle 42 remains fixed then the bolt carrier cam could force the bolt lugs to rotate in the same direction that they entered the breach. This can be prevented by employing a stop to prevent over rotation of the bolt 30.

The user then fires the round by pulling the trigger, which trips hammer 28 upward and forward though the open bottom 55 of the bolt carrier 50 to propel the firing pin through the bolt 30 and strike the cartridge primer. After firing, in FIG. 16 the user rotates the bolt coupler handle 42 out of receiver cam slot 66 by moving the bolt coupler handle 42 up and back through slot 66. The initial raising of the handle upward in slot lower portion 66*b* causes the bolt carrier 50 to rotate counterclockwise through about ⅔ of the rotation since bolt coupler lug 44 is engaged in pocket 58*b* of bolt carrier slot 58 right end. The engagement of bolt cam pin 34 at the forward end 54*a* of bolt carrier cam slot 52 simultaneously causes bolt lugs 32 to rotate counterclockwise with respect to the receiver breech 68. This also reengages bolt coupler lug 44 with the rear of bolt carrier slot right end 58*a*. The upper ⅓ of the counterclockwise rotation occurs as bolt coupler handle 42 passes upward and rearward through receiver cam slot upper portion 66*a*, which applies counterclockwise rotation and force rearward to bolt carrier 50, and which causes bolt lugs 32 to pass straight back through internal tracks 64 in receiver breech 68. As bolt coupler handle 42 and bolt carrier 50 move back the carrier cocks the hammer 28 rearward and the spent cartridge case is ejected through receiver opening 61. After the bolt coupler handle 42, bolt carrier 50 and bolt 30 are pulled all the way back to the position shown in FIG. 9, hammer 28 is then fully cocked and another round is ready to be stripped, chambered and fired.

Figure 17:
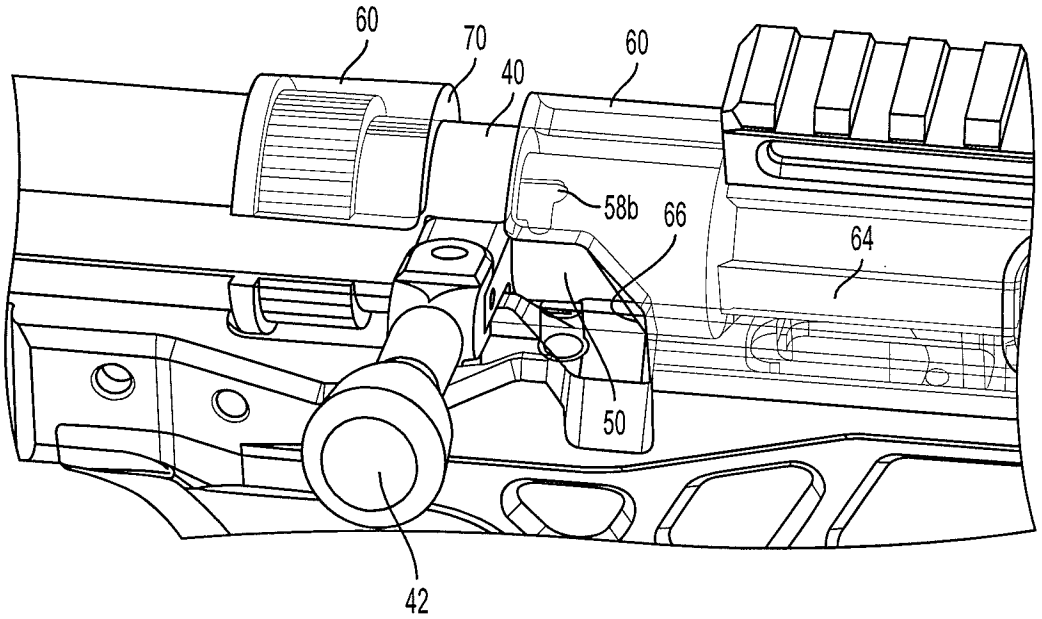
FIG. 17 is a semi-transparent perspective view of the rifle of FIG. 1 wherein, from the position of FIG. 9, the bolt coupler handle is pushed forward to chamber the cartridge and the bolt coupler align with the transverse rear peripheral track of the receiver.
Figure 18:
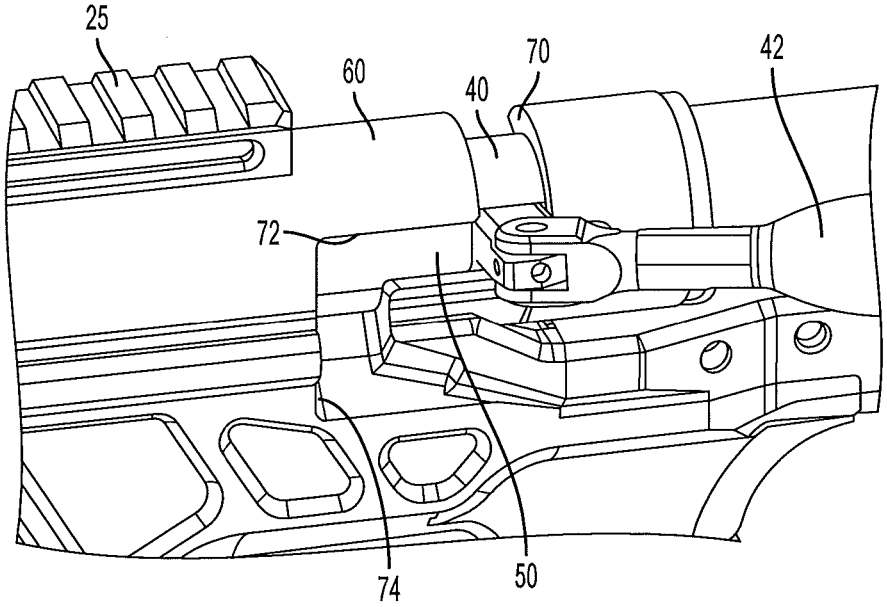
FIG. 18 is a semi-transparent perspective view of the rifle of FIG. 1 wherein the bolt coupler handle is rotated through the receiver track counterclockwise to the left side of the receiver, to the semi-automatic position.
Figure 19:
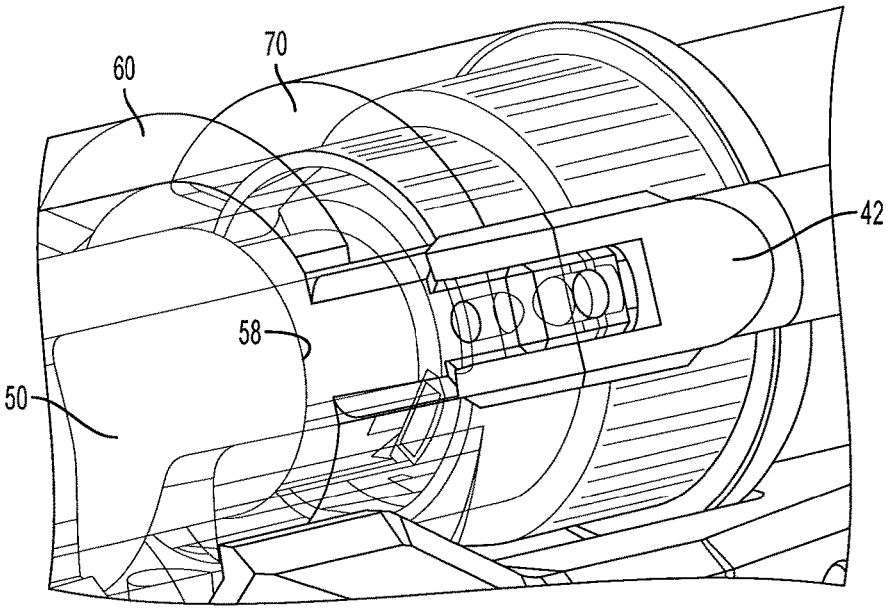
FIG. 19 is another semi-transparent perspective view of the rifle of FIG. 1 wherein the bolt coupler handle is rotated through the receiver track counterclockwise to the left side of the receiver, to the semi-automatic position.
Figure 20:
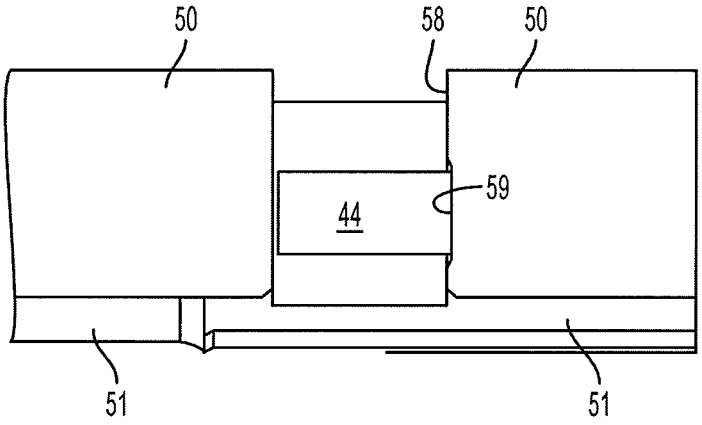
FIG. 20 is a side elevational view under the left side of the receiver of the rifle of FIG. 1 in the semiautomatic mode wherein, during the position of FIGS. 18 and 19 at the end of the counterclockwise rotation of the bolt coupler handle in the receiver track, the bolt coupler lug drops into a small pocket in the left side and rear of the bolt carrier slot to prevent the bolt carrier from further rotating relative to the bolt coupler.

The semi-auto mode firing sequence is shown in FIGS. 17-26 and can be described as follows. Bolt 30 may start in the rear position as in the start of the manual firing sequence shown in FIG. 9. As before, the operating spring 36 is uncompressed and the bolt cam pin 34 is seated at the forward end 54*a* of the bolt carrier cam slot portion 52*a*. In FIG. 17 the user pushes the bolt coupler handle 42 forward to align with transverse rear peripheral slot or track portion 70 of receiver 60. During this forward motion a cartridge 21 is chambered as in the manual mode. In FIGS. 18 and 19 the user rotates the bolt coupler handle 42 through receiver track 70 counterclockwise about 180 degrees over to the left side of receiver 60, to the semi-automatic position. The bolt coupler handle 42 can be folded back if necessary to bypass a scope on rail 25 by simply pulling the end out and rotating the handle 42 towards the rear of the weapon. During the counterclockwise rotation of handle 42, neither bolt 30 nor bolt carrier 50 rotate. At the end of the counterclockwise rotation of bolt coupler handle 42 in track 70, forward force from return spring 80 causes bolt coupler lug 44 to drop into a small pocket 59 in the left side and rear of bolt carrier slot 58 (FIG. 20), to prevent bolt carrier 50 from further rotating relative to bolt coupler 40.

Figure 21:
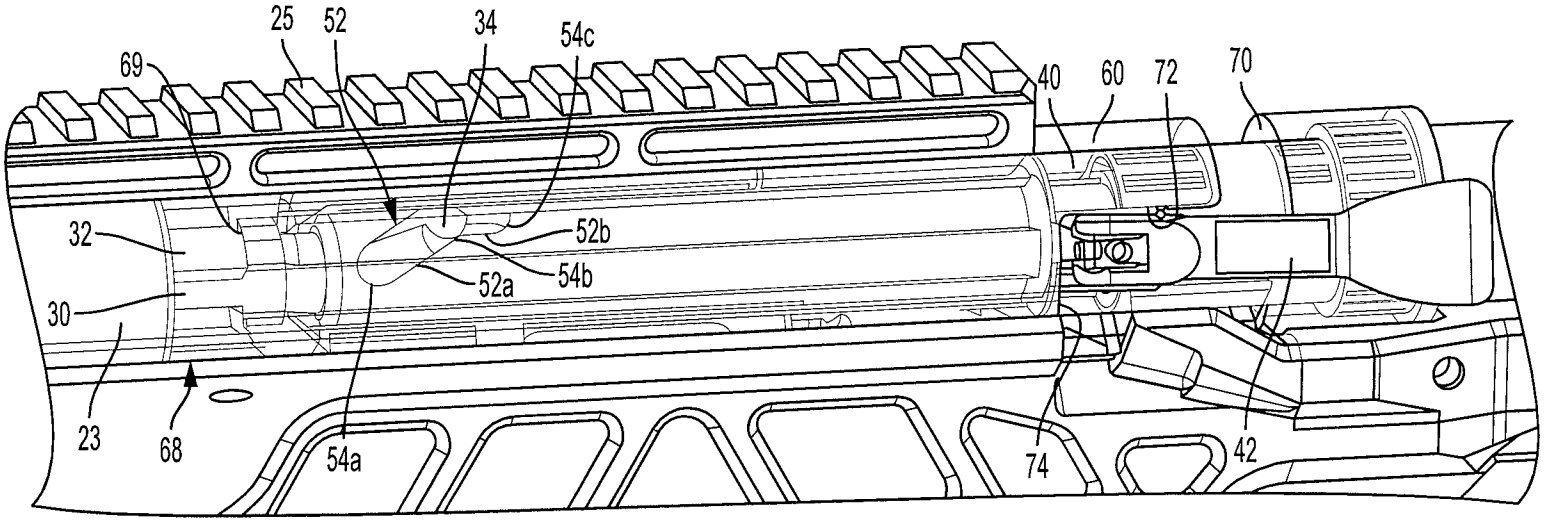
FIG. 21 is a semi-transparent perspective view of the rifle of FIG. 1 in the semiautomatic mode wherein the bolt coupler handle is pushed forward in the receiver left side longitudinal track portion and the bolt is rotated by the action of the bolt cam pin rearward through the forward angled portion of the bolt carrier cam, and the bolt lugs are fully rotated and captured in the receiver breech.
Figure 22:
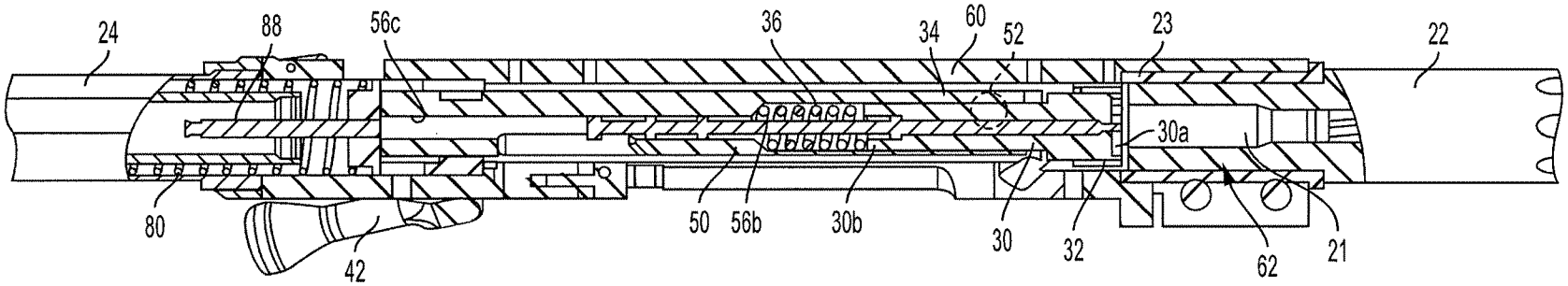
FIG. 22 is a side elevational cross section of the rifle of FIG. 1 in the semiautomatic firing position of FIG. 21 wherein the bolt cam pin is at the rear end of angled cam portion of the bolt carrier cam slot and the operating spring is uncompressed but engaged at its ends between the bolt rear end and the shoulder inside the bolt carrier.

In FIG. 21 the user pushes bolt coupler handle 42 forward in receiver left side longitudinal track portion 72. During this forward motion, at about 1/2 the distance through receiver track 72, bolt 30 begins to enter receiver breech 68. Bolt cam pin 34 is subsequently forced rearward from the forward end 54*a* of bolt carrier cam slot 52. Because rotation of bolt carrier 50 is prevented, the bolt 30 is rotated by the action of bolt cam pin 34 rearward through forward angled portion 52*a* of bolt carrier cam slot 52. The angle of cam slot portion 52*a* causes rotation of the bolt 30 to capture the bolt lugs 32 in receiver breech 68 and contact the cartridge 21 in firing position. When bolt coupler handle 42 slides fully forward in longitudinal track 72, bolt cam pin 34 reaches the rear end of angled cam portion 52*a* of the bolt carrier, at mid point 54*b*, where the straight cam portion 52*b* begins, and the bolt lugs 32 are fully rotated and locked inside of the receiver breech 68 (FIG. 22). When the bolt coupler handle 42 reaches the forward end of the receiver longitudinal slot 72 bolt coupler lug 44 also moves forward and out of pocket 59. In this position operating spring 36 is now engaged at its ends, but not compressed, by bolt rear end 30*b* and bolt carrier internal shoulder 56*b* (FIG. 22).

Figure 23:
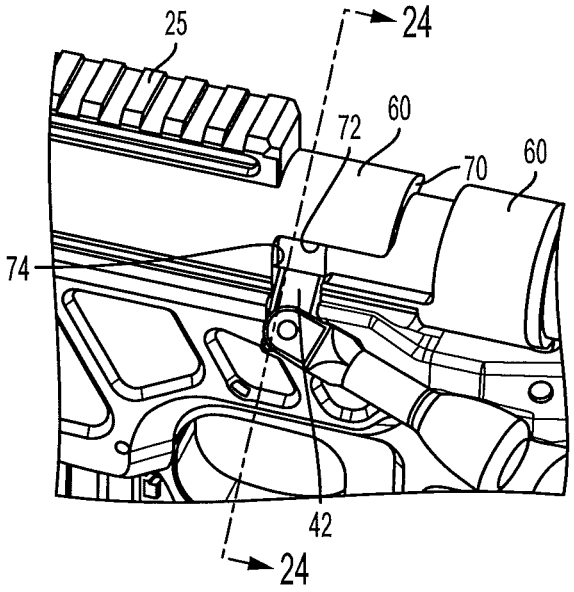
FIG. 23 is a semi-transparent perspective view of the rifle of FIG. 1 in the semiautomatic mode in firing position wherein the bolt coupler handle is rotated fully counter-clockwise and down in the receiver left side transverse slot portion to lock the handle with respect to the receiver.
Figure 24:
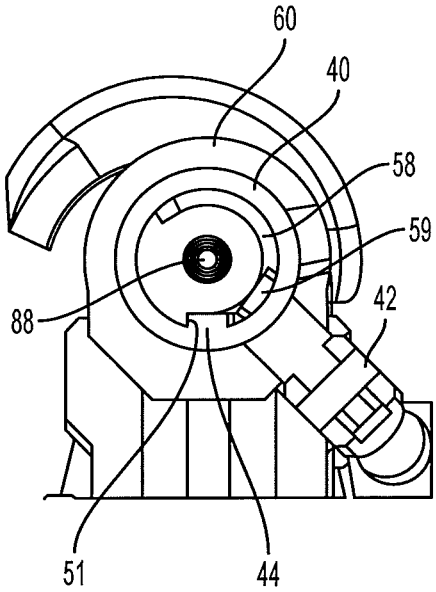
FIG. 24 is a cross section of the rifle of FIG. 1 in the semiautomatic firing position of FIG. 23, along line 24-24 of FIG. 23 and normal to the longitudinal axis, wherein the bolt coupler lug is in alignment with the longitudinal slot on the bottom left side of the bolt carrier so that, upon firing, the bolt carrier is free to slide longitudinally with respect to the bolt coupler and receiver.

In FIGS. 23 and 24 the user rotates bolt coupler handle 42 fully counterclockwise and down in the receiver left side transverse slot portion 74, and locks handle 42 with respect to receiver 60. Because bolt coupler lug 44 is no longer in pocket 59, the bolt carrier 50 and bolt 30 do not rotate further during this final handle downward motion. This also moves bolt coupler lug 44 into alignment with longitudinal slot 51 on the bottom left side of bolt carrier 50 (FIG. 24).

Figure 25:
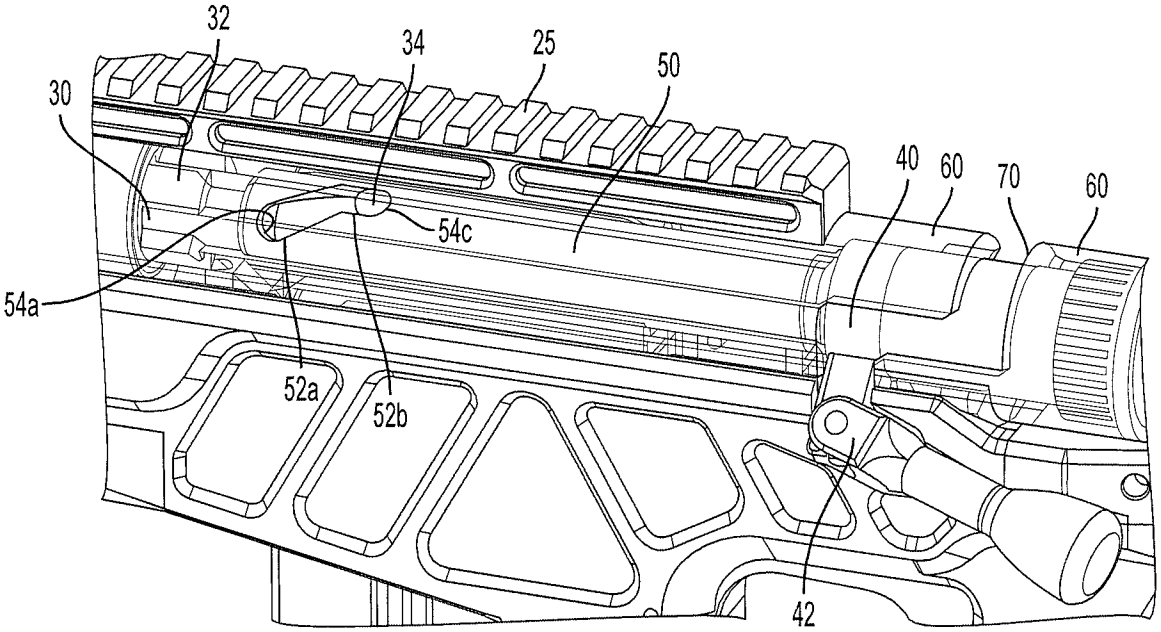
FIG. 25 is a semi-transparent perspective view of the rifle of FIG. 1 in the semiautomatic mode wherein after firing the bolt carrier moves forward with respect to the receiver and the bolt cam pin moves to the rear end of the bolt carrier cam slot and the operating spring achieves full compression from the recoil.
Figure 26:
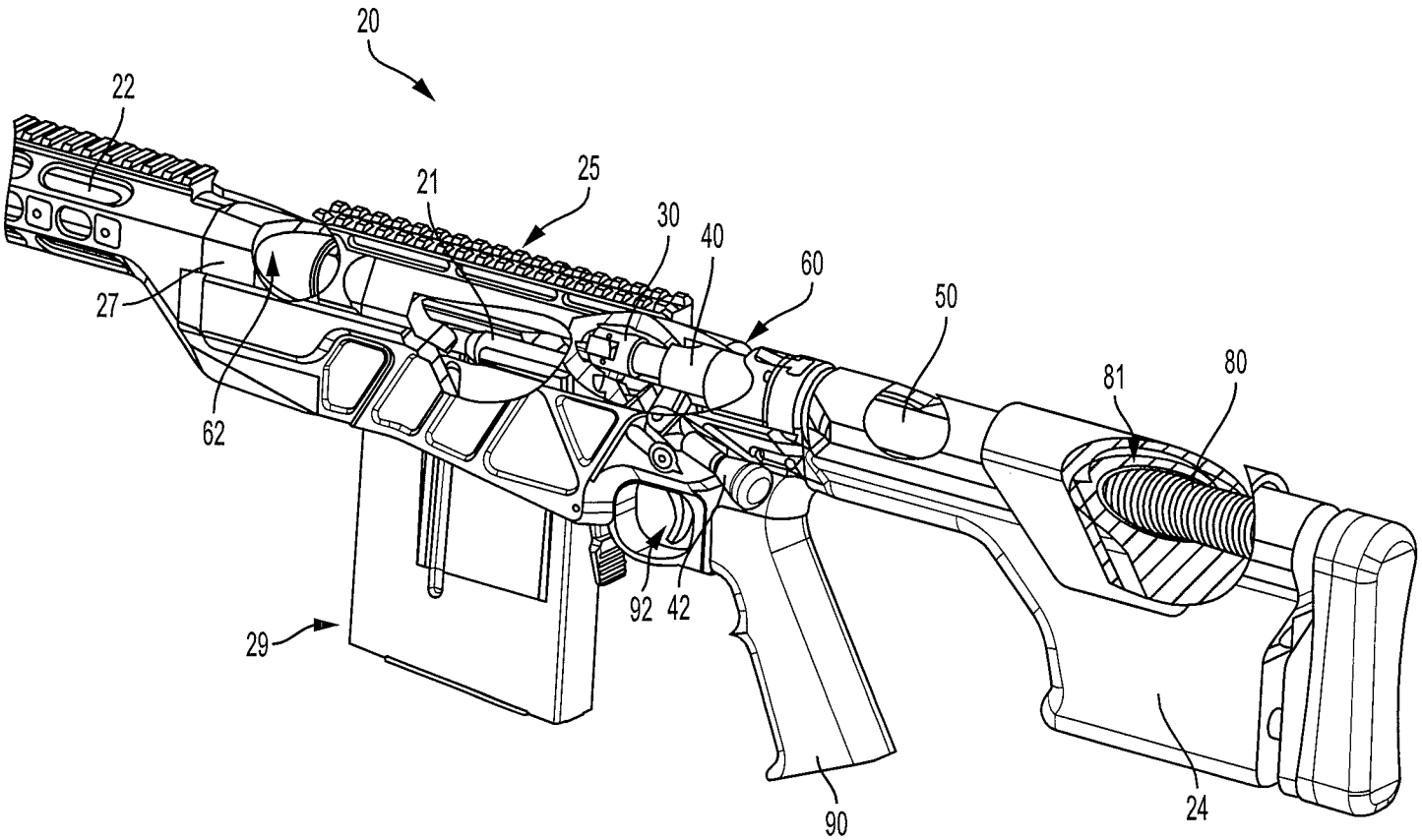
FIG. 26 is a semi-transparent perspective view of the rifle of FIG. 1 in the semiautomatic mode wherein after the position of FIG. 25, and after the bolt rotates and cams the bolt lugs and bolt out of the breach, the bolt and bolt carrier move rearward into the buffer tube, cocking the hammer and fully compressing the return spring.

The user pulls the trigger and fires the round by action of the hammer 28 and firing pin as previously described. Upon firing bolt carrier 50 is free to slide longitudinally with respect to the bolt coupler 40 and receiver 60 because of bolt coupler lug 44 in slot 51. Bolt carrier 50 is also free to slide longitudinally toward bolt 30 because bolt cam pin 34 is in the rearward straight cam portion 52*b* of the bolt carrier 50. The rifle is propelled rearwards from the recoil, and inertia causes bolt carrier 50 to move forward with respect to receiver 60 and bolt 30, whereupon the movement of bolt rear 30*b* and bolt carrier internal shoulder 56 toward each other causes operating spring 36 to compress. This causes the bolt cam pin 34 to move from the middle portion 54*b* to the rear end 54*c* of the bolt carrier cam slot 52 as shown in FIG. 25, where operating spring 36 achieves full compression from the recoil. After reaching full compression, operating spring 36 releases and begins to expand. This forces bolt carrier 50 rearwards so that bolt cam pin 34 begins to move to the forward position in bolt carrier cam slot 52. Because the bolt carrier 50 is still prevented from rotation by coupler lug 44 in longitudinal slot 51, the movement of bolt cam pin 34 forward through the bolt carrier cam straight portion 52*b* and then along cam angled portion 52*a* then rotates bolt 30 with respect to receiver breech 68 and cams the bolt lugs 32 and bolt 30 out of the breach. At the end of this rotation bolt cam pin 34 is once again at the forward end 54*a* of angled cam portion 52*a*. Once the bolt 30 is freed from breech 68, the combined rearward motion of the bolt 30 and bolt carrier 50 causes the bolt carrier 50 to cock the hammer 28 and eject the cartridge case. As the bolt 30 and bolt carrier 50 move rearward into the buffer tube, return spring 80 is compressed. After reaching full compression as shown in FIG. 26, return spring 80 releases and expands, which forces the bolt carrier 50 forwards which strips and chambers a new cartridge 21 round and cams the bolt 30 into the breach, leaving the firearm ready to fire again. Since hammer 28 is then cocked, the cartridge is ready to be fired again. Notwithstanding that operating spring 36 compresses and expands before return spring 80, the operating spring has a higher spring constant than the return spring.

If the firing in the semi-automatic mode malfunctions the following corrective actions may be taken.

Failure to fire: If the round does not fire after the trigger is pulled, the round can be cleared by rotating the bolt coupler handle and pulling the bolt out of the breach.

Failure to extract: If the round fires but does not extract and the bolt is still engaged with round the same procedure as a failure to fire may be taken to clear the weapon.

Failure to feed: Manual extraction by hand is performed.

The rifle of the present invention in manual bolt action mode is able to employ a bolt that is prevented from rotating and slipping rearward to maintain head space to tight specifications via the lock slot timing, and is able to achieve the desired tight breach and square ignition base critical for long range accuracy. Selecting semi-automatic mode is achieved by simply rotating the bolt handle 180 degrees to disengage the coupler to allow the inertial mechanism to move freely. The inertial mechanism comprises a moveable assembly of desired weight against the operating spring housed between the breech locked bolt face and bolt carrier. During recoil the operating spring is compressed and upon completion of the operating spring compression stroke and dispersion of recoil energy plane, the operating spring energizes cycling the bolt carrier rearward. Upon rearward movement, cartridge ejection, hammer and sear wipe down and compression of the return spring are achieved to the selected fire control mode. A lockout for semi, shot burst and/or continuous full automatic operation may be achieved.

Accordingly, the present invention provide a rifle in which operation may be controlled between a manual bolt action mode and a semiautomatic mode without removing components from the rifle. The rifle is field level convertible without disassembly or replacement of components between close quarters fire, mid range fire, and/or precision long range fire capabilities. Disassembly and replacement of the butt stock and caliber change are easily made.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A rifle comprising:

a receiver;

a cartridge chamber connected to the receiver;

a bolt slideable longitudinally in the receiver, the bolt being engageable with a cartridge in the cartridge chamber during firing of the cartridge; and a bolt carrier slideable longitudinally in the receiver to move the bolt into and out of engagement with a cartridge in the cartridge chamber, the bolt carrier being positionable between a manual position in which the bolt carrier is locked with respect to the receiver to prevent the bolt from moving rearward immediately after firing of the cartridge except by manual action of the user to move the bolt carrier and bolt rearward, and a semiautomatic position in which the bolt carrier is unlocked with respect to the receiver to enable the bolt carrier and bolt automatically to slide longitudinally with respect to the receiver immediately after firing of the cartridge.

2. The rifle of claim 1 wherein the bolt carrier has a slot extending around at least a portion of a periphery thereof, and further including a bolt coupler having a projection slideable within the bolt carrier peripheral slot, the bolt coupler being rotatable in one direction around the bolt carrier to lock the bolt carrier to prevent longitudinal movement with respect to the receiver and rotatable in an opposite direction around the bolt carrier to unlock the bolt carrier and permit longitudinal movement with respect to the receiver.

3. The rifle of claim 2 wherein the receiver has a slot extending around at least a portion of a periphery thereof, and further including a handle on the bolt coupler, the bolt coupler handle being slideable in the receiver slot as the bolt coupler is rotated to lock and unlock the bolt carrier with respect to the receiver.

4. The rifle of claim 3 further including an operating spring between the bolt and the bolt carrier, the operating spring being disengaged when the bolt carrier is in the manual position wherein the operating spring is uncompressed and the bolt and bolt carrier cannot move with respect to each other immediately after firing of the cartridge, the operating spring being engaged when the bolt carrier is in the semiautomatic position wherein the bolt and bolt carrier may move longitudinally with respect to each other to compress the operating spring immediately after firing of the cartridge.

5. The rifle of claim 4 wherein the bolt carrier includes a cam slot extending longitudinally and having an angled portion and the bolt has a pin slideable in the bolt carrier cam slot, and wherein position of the bolt pin in the cam slot controls compression and expansion of the operational spring between the bolt and the bolt carrier.

6. The rifle of claim 5 wherein in the bolt carrier manual position the bolt pin is at the forward portion of the bolt carrier cam slot and in the bolt carrier semiautomatic position the bolt pin is in an intermediate portion of the bolt carrier cam slot.

7. The rifle of claim 1 wherein the bolt carrier includes a cam slot and the bolt has a pin slideable in the bolt carrier cam slot, and wherein position of the bolt pin in the cam slot changes between the manual position in which the bolt carrier is locked with respect to the receiver and the semiautomatic position in which the bolt carrier is unlocked with respect to the receiver.

8. A method of controlling operation of a rifle between a manual bolt action mode and a semiautomatic mode comprising:

providing a rifle having a receiver, a cartridge chamber connected to the receiver, a bolt slideable longitudinally in the receiver, the bolt being engageable with a cartridge in the cartridge chamber during firing of the cartridge, and a bolt carrier slideable longitudinally in the receiver to move the bolt into and out of engagement with a cartridge in the cartridge chamber;

positioning the bolt carrier in a first manual position in which the bolt carrier is locked with respect to the receiver to prevent the bolt from moving rearward immediately after firing of the cartridge except by manual action of the user to move the bolt carrier and bolt rearward; and positioning the bolt carrier in a second semiautomatic position different from the first position in which the bolt carrier is unlocked with respect to the receiver to enable the bolt carrier and bolt automatically to slide longitudinally with respect to the receiver immediately after firing of the cartridge.

9. The method of claim 8 wherein position of the bolt carrier is changed without removing the bolt carrier from the rifle.

10. The method of claim 8 wherein position of the bolt carrier is determined by a bolt coupler having a handle, and further including moving the bolt coupler handle to change the bolt carrier from the first manual position to the second semiautomatic position.

11. The method of claim 8 wherein the bolt carrier includes a cam slot and the bolt has a pin slideable in the bolt carrier cam slot, and further including moving the position of the bolt pin in the bolt carrier cam slot to change the bolt carrier from the first manual position to the second semiautomatic position.

12. The method of claim 8 wherein the bolt carrier has a slot extending around at least a portion of a periphery thereof, and further including a bolt coupler having a projection slideable within the bolt carrier peripheral slot, and including rotating the bolt coupler in one direction around the bolt carrier to lock the bolt carrier to prevent longitudinal movement with respect to the receiver and rotating the bolt coupler in an opposite direction around the bolt carrier to unlock the bolt carrier and permit longitudinal movement with respect to the receiver.

13. The method of claim 12 wherein the receiver has a slot extending around at least a portion of a periphery thereof, and further including a handle on the bolt coupler, and including sliding the bolt coupler in the receiver slot as the bolt coupler is rotated to lock and unlock the bolt carrier with respect to the receiver.

14. The method of claim 13 further including an operating spring between the bolt and the bolt carrier, and including disengaging the operating spring when the bolt carrier is in the manual position wherein the operating spring is uncompressed and the bolt and bolt carrier cannot move with respect to each other immediately after firing of the cartridge, and engaging the operating spring when the bolt carrier is in the semiautomatic position wherein the bolt and bolt carrier may move longitudinally with respect to each other to compress the operating spring immediately after firing of the cartridge.

15. The method of claim 14 wherein the bolt carrier includes a cam slot extending longitudinally and has an angled portion and the bolt has a pin slideable in the bolt carrier cam slot, and including controlling compression and expansion of the operational spring between the bolt and the bolt carrier by position of the bolt pin in the cam slot.

16. The method of claim 15 wherein in the bolt carrier manual position the bolt pin is at the forward portion of the bolt carrier cam slot and in the bolt carrier semiautomatic position the bolt pin is in an intermediate portion of the bolt carrier cam slot.

17. A rifle comprising:

a receiver;

a cartridge chamber connected to the receiver;

a bolt slideable longitudinally in the receiver, the bolt being engageable with a cartridge in the cartridge chamber during firing of the cartridge;

a bolt carrier slideable longitudinally in the receiver to move the bolt into and out of engagement with a cartridge in the cartridge chamber; and a bolt handle connected to the bolt carrier, the bolt handle being positionable in a manual position extending from one side of the rifle to permit manual firing of the rifle and in a semiautomatic position about 180 degrees different from the manual position and extending from the other side of the rifle to permit semiautomatic firing of the rifle, wherein position of the bolt carrier may be changed between the manual and semiautomatic positions without removing the bolt carrier from the rifle.

18. The rifle of claim 17 wherein in the manual position the bolt carrier is locked with respect to the receiver to prevent the bolt from moving rearward immediately after firing of the cartridge except by manual action of the user to move the bolt carrier and bolt rearward and wherein in the semiautomatic position the bolt carrier is unlocked with respect to the receiver to enable the bolt carrier and bolt automatically to slide longitudinally with respect to the receiver immediately after firing of the cartridge.

19. A method of controlling operation of a rifle between a manual bolt action mode and a semiautomatic mode comprising:

providing a rifle having a receiver, a cartridge chamber connected to the receiver, a bolt slideable longitudinally in the receiver, the bolt being engageable with a cartridge in the cartridge chamber during firing of the cartridge, a bolt carrier slideable longitudinally in the receiver to move the bolt into and out of engagement with a cartridge in the cartridge chamber, and a bolt handle connected to the bolt carrier;

positioning the bolt handle in a manual position extending from one side of the rifle to permit manual firing of the rifle; and positioning the bolt handle in a semiautomatic position about 180 degrees different from the manual position and extending from the other side of the rifle to permit semiautomatic firing of the rifle, wherein position of the bolt carrier is changed between the manual and semiautomatic positions without removing the bolt carrier from the rifle.

20. The method of claim 19 wherein in the manual position the bolt carrier is locked with respect to the receiver to prevent the bolt from moving rearward immediately after firing of the cartridge except by manual action of the user to move the bolt carrier and bolt rearward and wherein in the semiautomatic position the bolt carrier is unlocked with respect to the receiver to enable the bolt carrier and bolt automatically to slide longitudinally with respect to the receiver immediately after firing of the cartridge.

* * * * *